US009352920B2

(12) United States Patent
Morelli et al.

(10) Patent No.: US 9,352,920 B2
(45) Date of Patent: May 31, 2016

(54) REWINDING MACHINE AND METHOD FOR THE PRODUCTION OF ROLLS OF WEB MATERIAL

(75) Inventors: Roberto Morelli, S. Maria a Colle (IT); Franco Montagnani, Palaia (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 520 days.

(21) Appl. No.: 13/261,620

(22) PCT Filed: Sep. 15, 2011

(86) PCT No.: PCT/IT2011/000320

§ 371 (c)(1), (2), (4) Date: Apr. 8, 2013

(87) PCT Pub. No.: WO2012/042549

PCT Pub. Date: Apr. 5, 2012

(65) Prior Publication Data

US 2013/0221150 A1 Aug. 29, 2013

(30) Foreign Application Priority Data

Sep. 28, 2010 (IT) ..... FI2010A0205

(51) Int. Cl.

| | |
|---|---|
| ***B65H 19/26*** | (2006.01) |
| ***B65H 19/22*** | (2006.01) |
| ***B65H 19/28*** | (2006.01) |
| ***B65H 19/30*** | (2006.01) |

(52) U.S. Cl.

CPC ..... *B65H 19/26* (2013.01); *B65H 19/2269* (2013.01); *B65H 19/267* (2013.01); *B65H 19/283* (2013.01); *B65H 19/305* (2013.01); *B65H 2301/41812* (2013.01); *B65H 2301/41814* (2013.01); *B65H 2408/235* (2013.01)

(58) Field of Classification Search

CPC ..... B65H 19/2269; B65H 19/283; B65H 19/267; B65H 19/29; B65H 2408/235

See application file for complete search history.

(56) References Cited

U.S. PATENT DOCUMENTS

| | | | |
|---|---|---|---|
| 4,783,015 | A | 11/1988 | Shimizu |
| 5,810,280 | A | 9/1998 | Ryan et al. |
| 5,964,389 | A | 10/1999 | Schmidt et al. |
| 5,979,818 | A | 11/1999 | Perini et al. |
| 6,098,916 | A | 8/2000 | Matteucci et al. |
| 6,648,266 | B1 | 11/2003 | Biagiotti et al. |
| 6,948,677 | B2 | 9/2005 | Biagiotti et al. |
| 7,318,562 | B2 | 1/2008 | Biagiotti et al. |
| 7,494,086 | B2 | 2/2009 | Tsai |
| 7,775,476 | B2 | 8/2010 | Recami et al. |
| 2007/0176039 | A1 | 8/2007 | Gelli et al. |
| 2009/0302146 | A1 | 12/2009 | Morelli et al. |

FOREIGN PATENT DOCUMENTS

| | | |
|---|---|---|
| EP | 1 262 434 A2 | 12/2002 |
| EP | 1 982 939 A1 | 10/2008 |

*Primary Examiner* — Luis A Gonzalez

(74) *Attorney, Agent, or Firm* — Breiner & Breiner, L.L.C.

(57) ABSTRACT

A rewinding machine is described with a winding cradle defined by three rollers and including a fourth winding roller, defining with the first winding roller a cradle in which the web material is pushed by a winding core to the beginning of each winding cycle, to cause severing of the web material without the need for controlled mechanical parts.

32 Claims, 28 Drawing Sheets

27
2
9
9A
f9
7
7A
N
fN
23A
L1
A1
1
1A
23
25
5
21
3A
19A
19B
21A
31
3
17A
A2
19
1B
13
15
C
1C
17
17B
11
3B
3C
PA 27
2
9
9A
f9
7
7A
L1
A1
fN
23A
1
1A
23
5
21
25
3A
3
19A
1B
21A
A2
19
17A
13
C
17
11B
1C
11
3C
3B 27
2
9A
fg
9
23A
7
fN
N
1
7A
1A
5
L2
23
21
A2
3A
3
1B
21A
19A
31
19B
17A
19
13
15
1C
17
17B
11
3B
3C 27
2
9A
fg
9
23A
N
fN
1
7
7A
1A
L2
A2
23
1B
21A
3A
19A
31
3
17A
21
19
15
19B
13
1C
17
17B
11
3C
3B 27
2
9
9A
fg
7
7A
N
fN
23A
L2
A2
1
1A
23
25
5
21
3A
19A
19B
21A
31
3
17A
A3
19
15
1B
13
C
1C
17
17B
11
3B
3C
PA 27
2
9
9A
f9
7
7A
N
23A
fN
L1
A1
1
1A
25
5
23
21
3A
19A
19B
21A
31
3
17A
A2
19
15
1B
13
C
1C
17
17B
11
3B
3C
PA 27
2
9
9A
fg
7
7A
L1
A1
fN
23A
1
1A
23
5
21
25
3A
3
19A
1B
21A
A2
19
17A
13
C
17
17B
1C
11
3C
3B 27
2
9A
f9
9
23A
N
fN
7
7A
1
1A
5
L2
23
21
A2
3A
21A
19A
1B
31
3
19B
17A
19
15
13
1C
17
17B
11
3B
3C 27
2
9A
f9
23A
N
fN
1
7
7A
1A
L2
A2
23
21
25
21A
19A
3A
1B
31
3
19B
17A
19
13
15
11
1C
17
17B
3B
3C 27
2
9A
f9
9
7
7A
23A
N
fN
1
1A
A2
L2
23
5
21
25
19A
3A
3
21A
31
1B
19B
17A
A3
19
13
C
11
1C
17
3B
3C 27
2
9
9A
f9
7
7A
N
23A
fN
L1
A1
1
1A
5
23
21
25
3A
3
21A
31
3B
1B
19
19A
19B
17
1C
52A
50
22
C
17A
20
52
45
A2
18

27
2
9
9A
f9
7
7A
N
fN
23A
L1
A1
1
1A
5
23
21
25
3A
3
31
21A
1B
C
19
3B
A2
22
17
1C
50
18
52A
17A
52
20
45

27
2
9
9A
f9A
7
7A
N
fN
23A
L1
A1
1
1A
P2
25
LC
LT
23
21
A2
3A
3
21A
1B
P1
19A
31
19
19B
1C
3B
18
50
3C
C
17A
18
52
52A
A3
22
45
17
20

27
2
9A
f9
9
23A
7
N
fN
1
7A
1A
23
L2
A2
3A
21A
A
1B
19A
19
3
31
19B
3B
1C
17
52A
22
C
52
A3
17A
18
20
45

27
9A
9
2
f9
23A
fN
N
7
1
7A
L2
A2
23
21
3A
21A
3
1B
3B
19A
19
1C
52A
17
22
C
17A
52
18
20
45

27
2
9A
9
f9
7
N
23A
23
fN
7A
1
1A
A2
L2
5
3A
3
31
19A
19
1B
3B
19B
1C
52A
17
22
C
17A
52
A3
18
20
45

27
2
9
9A
f9
7
7A
N
23A
fN
L2
A2
1
5
23
21
25
3A
3
21A
31
1B
19
3B
19A
19B
17
1C
52A
50
22
C
17A
20
52
45
A3
18

27
2
9
9A
f9A
7
7A
L1
A1
N
fN
23A
1
1A
P2
100
LC
LT
23
A2
3A
3
21A
1B
P1
19A
21
31
19
1C
3B
18
3C
C
17A
52
52A
A3
22
45
17
20

2
27
9
9A
f9
7
7A
L1
A1
N
fN
23A
1
1A
5
3A
3
23
21
25
31
21A
1B
C
19
3B
A2
22
17
1C
50
18
52A
17A
20
52
45

REWINDING MACHINE AND METHOD FOR THE PRODUCTION OF ROLLS OF WEB MATERIAL

TECHNICAL FIELD

The present invention concerns methods and machines for the production of rolls of web material, in particular but not exclusively rolls of paper, such as tissue paper, for example toilet rolls, kitchen paper or similar.

BACKGROUND ART

In the paper industry, in particular for the production of toilet rolls, kitchen paper or similar, large reels (parent reels) of tissue paper coming directly from the continuous production machine are wound. These large reels are then unwound and rewound to produce rolls or logs of smaller diameter, corresponding to the diameter of the finished product intended for sale. These rolls have an axial length equal to a multiple of the finished roll intended for distribution and sale and are therefore cut by cutting-off machines to obtain the finished product for packaging and subsequent sale. For the production of logs or rolls of web material, the modern rewinding machines are provided with winding rollers which, combined and arranged in various ways, and appropriately controlled, allow automatic production in rapid sequence of logs or rolls by continuous feed of the web material. After a roll has been wound, it must be moved away from the winding area, severing (by cutting, tearing or other method) the web material so that the next roll or log can be wound. Normally winding is performed around winding cores, typically but not exclusively made of cardboard, plastic or other similar suitable material. In some cases winding is performed around extractable recyclable spindles, which are removed from the finished roll and reinserted in the rewinding machine in order to wind the next roll.

In more modern rewinding machines, the winding movement is imparted to the logs or rolls being formed by the contact of two or more rollers rotating at controlled speed. These rewinding machines are called peripheral or surface rewinding machines, since the winding movement is imparted peripherally by contact between the surface of the winding rollers and the surface of the rolls or logs being formed. Examples of automatic continuous surface rewinding machines of this type are described in U.S. Pat. No. 5,979,818 and in other patents of the same family, and in the patent literature cited in this patent.

These machines are also called continuous and automatic, as the various phases of the winding cycle of each roll follow one another automatically, passing from the production of one roll to the next, without interrupting the feed of the web material and at roughly constant or substantially constant speed.

In some known embodiments the peripheral rewinding machines are also provided with central winding control systems in order to obtain higher quality products. The central control is obtained by means of a spindle or a pair of motorized tailstocks engaged with the winding core. Examples of machines of this type are described in U.S. Pat. No. 7,775,476 and in the publication US-A-2007/0176039, the content of which is incorporated in the present description and which can be referred to for further details relative to these types of devices.

In these machines the core around which the roll forms is kept in rotation and controlled in its movement by the combined effect of peripheral winding rollers and motorized tailstocks which engage the ends of the winding core for at least a part of the formation cycle of each roll or log.

One of the critical phases in the automatic continuous peripheral rewinding machines of the type described above is the so-called exchange phase, i.e. severing of the web material, unloading of the completed roll and beginning of winding of a new roll around a new winding core inserted in the winding nip.

Various solutions have been studied to perform these operations automatically, rapidly and effectively, for example via the use of winder rollers rotating at a controlled speed which accelerate and/or decelerate in a synchronized manner in order to favor correct movement of the completed rolls and new cores. In some cases tear systems are provided, where the web material is separated after winding by means of speed difference. In other cases pressurized air or suction systems, mechanical systems or similar are used to sever the web material.

Control of the winding rollers and means for separation or severing of the web material is one of the critical aspects of the exchange phase of the finished roll and its replacement with the new winding core for the formation of the next roll.

SUMMARY OF THE INVENTION

According to the invention, a new winding method is suggested, which overcomes wholly or partly one or more of the drawbacks of the continuous peripheral rewinding machines of known type. More specifically, according to some aspects, the invention suggests a winding method which allows simple efficient and controlled performance of the exchange phase at the end of winding of each roll and at the beginning of winding of each new subsequent roll.

Substantially, according to the invention, in a method for the production of rolls or so-called logs of web material, the web material is severed after winding of a roll or log (to create a free trailing edge of the completed roll and a free leading edge of a new roll from which winding on a new core is started) by lengthening the path of the web material between two points of the web material which advance at a controlled speed, preferably the same for the two points, when the web material comes into contact with a new winding core. Said two points are for example the contact points of the web material with mechanical parts at controlled speed, on which the web material is guided. The term point is not intended in a geometric sense but as a limited area of the web material in a given position of its longitudinal development. The two points can be defined by two rollers around which the web material is guided, said core being moved against one of said two rollers, pinching the web material between said core and said roller.

According to some embodiments, the invention provides a method for winding a web material around a winding core and producing a roll of web material, comprising the following steps:

- winding a pre-set quantity of web material around a first winding core to form a first roll;
- after winding of said first roll, severing the web material by lengthening the path of the web material between two substantially parallel rollers, around which said web material is guided.

The lengthening can be obtained by spacing said two substantially parallel rollers. To maintain correct control of the web material, a winding core is brought into contact with the web material entrained around one of said rollers, pinching the web material between roller and winding core. More specifically, the core is brought into contact with the roller further upstream with respect to the advancing direction of the web material. Lengthening of the path of the web material is advantageously performed preferably only after pinching of the web material between the core and the roller, thus obtaining optimal control of the web material.

In a particularly advantageous embodiment, the path of the web material between the two rollers is lengthened by forcing the web material between the two winding rollers by means of a new winding core around which winding of the next roll or log begins. In this case the winding core is brought into contact with the web material and pinches the web material between the core and the roller and then, rolling around the roller, pushes the web material towards the inside of the nip between the two rollers around which the web material is guided, causing lengthening and severing thereof, i.e. interruption along a perforation line, for example. This embodiment of the invention avoids the need for spacing the two rollers with a reciprocal distancing movement which would have to be very rapid and precise, thus resulting in a method which is simpler to control and more reliable, and also reduces wear on the mechanical parts.

In some possible embodiments, before lengthening the path of the web material, the latter is tensioned to facilitate severing.

According to these embodiments, severing of the web material does not require cutting or severing members with parts subject to wear. The web material is subjected to limited stress and is handled in order to reduce the formation of folds or irregularities in the initial winding phase around the winding core.

By appropriately controlling the movement of the parts of the rewinding machine, furthermore, it is possible to effectively reduce the length of the web material between the severing line and the line of adhesion to the winding core.

All this helps to obtain a better quality product.

In a per se known manner, the web material can be perforated along perforated lines substantially transversal with respect to the longitudinal development of the web material in order to divide the latter into a plurality of portions or sheets which can be detached at the moment of use along tearing lines defined by the perforations. In this case the web material is preferably severed along a perforation line, synchronizing the path lengthening phase with the position of the perforation line along the web material. In some embodiments, the winding core is provided with at least one line of glue to ensure adhesion of the leading edge of the web material obtained by severing the web material after winding of a roll. In this case, advantageously, the angular position of the line of glue during insertion of the winding core into the machine and in contact with the web material is such as to minimize the length of the web material between the material severing line and the line of glue. In this way even better quality of the finished product is obtained.

In preferred embodiments of the method according to the invention, the web material is fed at a substantially constant speed during the various steps of the winding cycle so that winding of subsequent rolls and the exchange phase, i.e. severing of the web material, unloading of the completed log or roll, beginning of winding of the next roll or log, are performed with a substantially constant feed of the web material.

In some embodiments, the method comprises the following steps:

providing a first winding roller and a second winding roller defining a winding nip through which said winding cores and said web material pass;

providing, downstream of said winding nip, a third winding roller, defining a winding cradle with the first winding roller and with the second winding roller;

providing, upstream of said winding nip, a fourth winding roller, defining with the first winding roller a cradle for severing the web material;

feeding the web material around the fourth winding roller and the first winding roller, through said winding nip towards the winding cradle and wind said web material around the first winding core in said winding cradle to form said first roll;

inserting said second winding core towards the fourth winding roller;

lengthening the path of the web material between the fourth and the first winding roller causing severing of the web material at a point between the second winding core and the first roll.

Preferably the lengthening is obtained by inserting the second winding core towards the inside of a severing cradle defined between the fourth and the first winding roller.

In preferred embodiments of the invention, the method comprises the following steps:

feeding the web material around the fourth winding roller and the first winding roller, through said winding nip towards the winding cradle and winding at least a part of said web material around the first winding core in said winding cradle to form said first roll;

inserting a second winding core in the severing cradle between the fourth winding roller and the first winding roller, lengthening the path of the web material and causing severing of the web material at a point between the second winding core and the first roll;

keeping the second winding core between the first winding roller, the second winding roller and the fourth winding roller to wind a first quantity of web material on said second winding core;

gradually displacing the second winding core and the second roll that is forming therearound through the winding nip and into the winding cradle defined by the first winding roller, the second winding roller and the third winding roller, continuing to wind said web material around said second winding core;

completing winding of the second roll in said winding cradle.

Preferably, in the first part of the winding cycle of each log or roll, the roll that begins to form around the new winding core is kept in contact with the fourth winding roller during at least a part of the advancing movement through the winding nip. To obtain optimal control of the roll during each phase of the winding cycle and therefore improve the quality of the finished product, the fourth winding roller can be moved away from the roll being formed only when the third winding roller begins to act on the roll. In this way, at every moment of the winding cycle, the roll is always controlled by three winding rollers. In preferred embodiments of the invention, the contact between the roll and the fourth winding roller ceases after the roll has completed a plurality of rotations around the axis thereof (and therefore a quantity of web material has been wound on it) keeping the roll in contact with all four winding rollers. This intermediate phase of the winding cycle can also constitute the substantial part of the winding cycle, i.e. a part during which a preponderant length of web material is wound on the roll, typically for example half or more than half the overall length of web material wound on each individual roll.

In some embodiments a further winding control can be obtained by inserting in the terminal ends of the winding core respective tailstocks, preferably motorized and driven at a controllable speed in a manner coordinated with the rotation speed of the winding rollers. Said tailstocks can be inserted after the leading edge of the web material has been made to adhere on the winding core, and if necessary after a fraction of a loop, or a loop or even more than one loop of web material has been wound around the core. The tailstocks can remain engaged in the winding core until winding is nearly completed. Preferably the time during which the tailstocks remain engaged with the winding core is such as to permit release of the tailstocks from a roll almost formed and re-setting of them to the position in which the next roll beings to wind, thus making it possible to use only one pair of tailstocks. The possibility of using two pairs of tailstocks, which operate alternatively on consecutive rolls, is not excluded.

To facilitate the winding phase that follows formation of the first loop(s) of web material, according to some embodiments of the method according to the invention, the first winding roller and the second winding roller are moved away from each other during the passage of the new winding core through the winding nip while a part of the roll of web material being wound is forming around it. This reciprocal distancing movement can be obtained by keeping one of the two winding rollers (first and second winding roller) defining the winding nip at a standstill, for example the first winding roller around which the web material is guided, and moving the axis of the second winding roller only or, conversely, keeping the rotation axis of the second winding roller fixed and moving the axis of the first winding roller. The condition of movement or the condition of immobility of the roller axes refer to a static supporting structure of the machine parts. The spacing or reciprocal distancing of the winding rollers allows the roll being formed in the nip to be kept between the rollers for a good length of time, defining an intermediate phase of the winding cycle. During this interval of time, the diameter of the roll being formed increases considerably and the reciprocal distancing of the first and second winding roller provides space for the roll which is increasing in diameter. Preferably both winding rollers are moved in a substantially symmetrical manner with respect to a plane of symmetry on which the winding core axis lies and moves; said winding core therefore advances according to a path which is preferably at least partly straight. This allows more uniform winding to be obtained and simplifies the movement of any auxiliary tailstocks used in combination with the winding rollers.

Generally the first winding roller, the second winding roller, the third winding roller and the fourth winding roller rotate substantially at the same peripheral speed for a preponderant part of the winding cycle of each roll. Preponderant part of the winding cycle generally means the winding cycle excluding the transitory exchange phase, during which a differential speed is set between the rollers of at least one pair of winding rollers to cause, promote or control the advancing movement of the new winding core and/or of the completed roll or log.

Preferably, the first and the fourth winding roller are always maintained at a substantially constant speed, since the advancing movement of the winding cores and unloading of the formed rolls or logs can be imparted and controlled by acting only on the speed of the second winding roller, or if necessary in combination on the speed of the second winding roller and third winding roller, as will be clarified with reference to the detailed description of exemplary embodiments of the invention.

To angularly accelerate each new core inserted in the rewinding machine, according to preferred embodiments of the invention the new winding core is forced between the fourth winding roller and a stationary plate positioned at a distance from said fourth winding roller such as to cause pinching of the web material between said fourth winding roller and the new winding core when the latter is forced between said stationary plate and said fourth winding roller. The stationary plate advantageously defines an advancing channel roughly concentric to the fourth winding roller, along which the winding core advances rolling on the stationary plate due to the effect of contact with the web material entrained around the fourth winding roller, which therefore imparts the advancing movement to the core. In this phase, the axis of the winding core advances along the channel at a speed which is approximately equal to half the advancing speed of the web material.

According to a different aspect, the invention provides a peripheral rewinding machine for the production of rolls of web material wound on winding cores, comprising a cradle defined between two rollers around which the web material is guided, and a winding core inserter arranged and controlled to insert winding cores towards said cradle. The machine is also provided with members for lengthening the advancing path of the web material until causing the severing thereof to begin winding of a new roll on a new winding core.

According to preferred embodiments of the invention, the rewinding machine comprises: a first winding roller and a second winding roller defining a winding nip through which said winding core passes; an inserter to insert winding cores towards said winding nip, said winding cores crossing said winding nip; a third winding roller positioned downstream of said winding nip, said first winding roller, said second winding roller and said third winding roller defining a winding cradle; a feed path of said web material extending through said winding nip; upstream of said winding nip, a fourth winding roller spaced from said first winding roller and forming with it a severing area of the web material; the path of the web material extending around said fourth winding roller and around said first winding roller.

In some embodiments the first winding roller and the fourth winding roller are arranged and controlled so that the winding core is moved by the inserter towards the fourth winding roller to pinch the web material between said fourth winding roller and said winding core.

In advantageous embodiments, the rewinding machine comprises an element to lengthen the web material until severing said web material between the first winding roller and the fourth winding roller after the winding of each roll.

Preferably, the first winding roller, the second winding roller and the fourth winding roller and the inserter are arranged and controlled to insert at least partially the winding core in a cradle for severing the web material, defined between the first winding roller and the fourth winding roller, thus causing lengthening of the path of web material and severing of the web material between said winding core and a roll being formed in the winding cradle.

In other embodiments the fourth winding roller and the first winding roller are movable in relation to one another in a controlled manner to increase the distance between the centers of said first winding roller and said fourth winding roller after the winding of a roll of web material, causing a lengthening of the path of the web material between said first winding roller and said fourth winding roller until the web material is severed.

According to another embodiment, the invention concerns a method for the production of rolls of web material, in which the web material is guided around two rollers and in which the web material is severed after the winding of a roll or log by lengthening a path of the web material between said two rollers. Preferably, the path is lengthened by pushing the web material by means of a new winding core towards a nip between said two rollers.

According to a further embodiment, the present invention concerns a peripheral rewinding machine for the production of rolls of web material wound on winding cores, comprising two rollers around which the web material is guided and an arrangement to lengthen the advancing path of the web material between said two rollers until it is severed to begin winding of a new roll on a new winding core. This arrangement can comprise an winding core inserter positioned and controlled to insert winding cores towards a cradle defined between said two rollers around which the web material is guided, the insertion of a winding core in said cradle causing lengthening of the web material and the severing thereof.

According to a further embodiment, the invention concerns an automatic continuous peripheral rewinding machine for the production of rolls of web material wound around winding cores, comprising four winding rollers defining a winding space through which the winding cores are gradually advanced to form respective rolls or logs of web material around said cores. The winding rollers are controlled so that during the winding cycle the roll being formed is in contact with at least three rollers and preferably with four rollers during the central phase of the winding cycle. The rewinding machine is continuous and automatic, as the web material is fed in a continuous manner and at a substantially constant speed and the winding cores are inserted in the winding area defined by the four rollers in a continuous sequence, so that a new core is inserted when the roll or log wound on the preceding core is unloaded from the winding area defined by the winding rollers. By substantially constant speed a speed is meant that varies for the sole purposes of maintaining the necessary tension of the web material, and which for example does not vary more than 2% with respect to a nominal speed and preferably no more than 1% with respect to the nominal speed.

The web material is severed to generate a free leading edge and a free trailing edge without interrupting the advancing of the web material, for example causing a localized lengthening of a portion of the web material when a roll has been completed and a new core is in contact with the web material to engage with it the free leading edge formed by the tearing or severing of the web material, for example by means of a line of glue. The lengthening can be obtained by tensioning the web material by means of a new winding core in a cradle defined between two of the four winding rollers.

In a particularly advantageous embodiment the rewinding machine comprises four winding rollers defining a first winding cradle between a first winding roller, a second winding roller and a third winding roller, and a second winding cradle between said first winding roller, said second winding roller and a fourth winding roller; said first winding roller and said second winding roller defining a nip through which the winding cores pass, around which said web material is wound, and through which the web material is fed towards a roll being formed in the first winding cradle; wherein said winding rollers are positioned and controlled to perform a first portion of the winding of a roll between said first winding roller, said second winding roller and said fourth winding roller and a last portion of the winding of a roll between said first winding roller, said second winding roller and said third winding roller, said third winding roller being positioned downstream of said nip and said fourth winding roller being positioned upstream of said nip in relation to the advancing direction of the winding cores.

Further possible features and preferred embodiments of the invention are described below with reference to the accompanying drawings and are defined in the attached claims, which form an integral part of the present description.

BRIEF DESCRIPTION OF THE DRAWINGS

The invention will be better understood by following the description and the accompanying drawing, which shows a practical non-limiting embodiment of the invention. More specifically, in the drawing.

DETAILED DISCLOSURE OF EMBODIMENTS OF THE INVENTION

Figure 1:
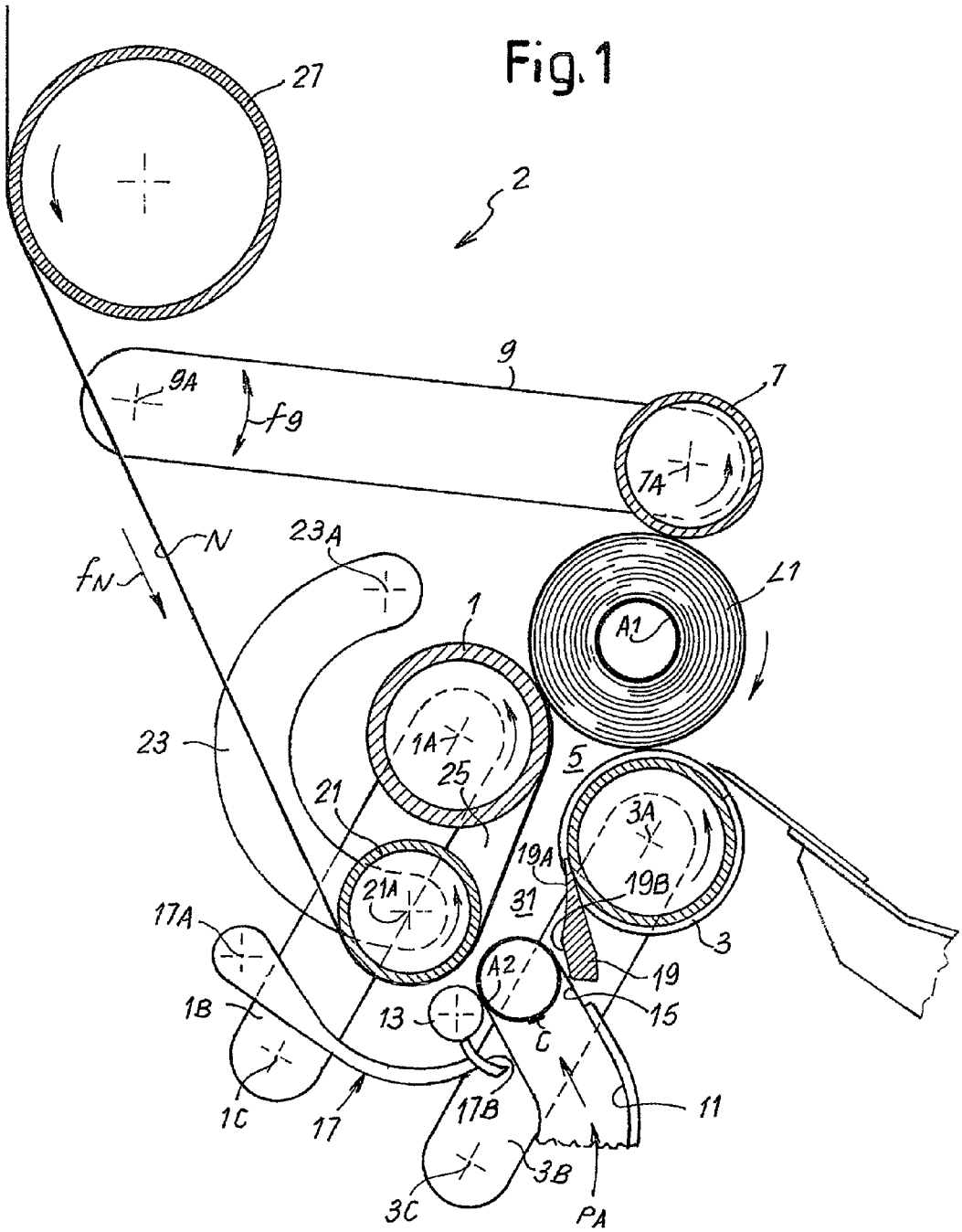
FIGS. 1 to 8 show a first embodiment of the rewinding machine according to the invention, in a work sequence which illustrates the operating method.

FIGS. 1 to 8 show a first embodiment of a continuous peripheral rewinding machine according to the invention and an operating sequence, which shows in particular the exchange phase, i.e. unloading of a log or roll, winding of which has been completed, and the insertion of a new winding core to begin the formation of a subsequent log or roll.

FIGS. 1 to 8 show the main elements of the rewinding machine according to the invention, limited to what is required for understanding the concepts underlying the invention and operation of the machine. Construction details, auxiliary units and further components known per se and/or which can be designed according to the known art, are not illustrated in the drawing or described in further detail; a person skilled in the art can design these further components on the basis of his experience and knowledge in the field of paper converting machines.

In short, in the embodiment illustrated in FIGS. 1 to 8 the machine, indicated overall by 2, comprises a first winding roller 1 with a rotation axis 1A, arranged alongside a second winding roller 3 having a rotation axis 3A. The axes 1A and 3A are parallel to each other. Between the two winding rollers 1 and 3 a winding nip 5 is defined, through which a web material N is fed to be wound around a winding core A1 around which a first roll or log L1 forms. As will become clear from the description below, the winding cores also cross the winding nip 5, since they are inserted in the machine upstream of the nip 5 and finish receiving the web material N wound around them when they are in the winding cradle defined not only by the rollers 1 and 3, but also by a third winding roller 7, downstream of the winding nip 5. 7A indicates the rotation axis of the third winding roller 7, parallel to the axes 1A and 3A of the first winding roller 1 and the third winding roller 3 respectively.

In the present description and the accompanying claims, the definition "up-stream" and "downstream" refers to the advancing direction of the web material and axis of the winding core, unless otherwise specified.

The third winding roller 7 is provided with a movement towards and away from the winding nip 5. For said purpose, in some embodiments, the third winding roller 7 is supported by a pair of arms 9 hinged around an axis 9A to pivot according to the double arrow f9.

Upstream of the winding nip 5, the first winding roller 1 and the second winding roller 3, a core feed device 11 is arranged, which can be designed in any suitable manner.

The winding cores can come from a core winder, combined with the web material N processing line in which the rewinding machine 2 is inserted.

The winding core feeder 11 is configured in this embodiment so as to define a core feeding path PA, which terminates near the first winding roller 1 and the second winding roller 3 upstream of the winding nip 5. In this area means for temporarily retaining the winding cores can be provided. In some embodiments these retaining means can comprise a bar or roller 13 opposite a lamina or a series of elastic laminas 15. The winding core feed path PA extends between the roller or bar 13 and the lamina(s) 15.

The winding core feeder 11 is combined with an inserter 17 to insert the winding cores towards the roll formation area. In some embodiments the inserter 17 is a pusher. In the embodiment example illustrated, the inserter 17 comprises one or more pivoting arms hinged around a pivoting axis 17A and defining a push element 17B which cooperates with the cores to insert them in the winding area, i.e. in the winding head of the rewinding machine 2 as will be described in further detail below with reference to the operating sequence illustrated in FIGS. 1 to 8.

In some embodiments, between the terminal area of the feeder 11 and the second winding roller 3 a stationary plate 19 is positioned provided with a shaped surface 19A, 19B, the function of which will be described in further detail below.

Upstream of the winding nip 5 defined between the first winding roller 1 and the second winding roller 3 a fourth winding roller 21 is positioned, with a rotation axis 21A substantially parallel to the axes 1A, 3A and 7A of the first winding roller 1, the second winding roller 3 and the third winding roller 7 respectively. In some embodiments the fourth winding roller 21 is supported by a pair of pivoting arms 23 hinged around the pivoting axis 23A. In some embodiments, the pivoting arms 23 supporting the fourth winding roller 21 have an arched shape as illustrated in the drawing.

Between the first winding roller 1 and the fourth roller 21 an area for severing the web material is defined, i.e. an area in which the web material is severed to generate a free trailing edge of the roll L1 during the completion phase and a free leading edge to start winding of the next roll L2. In practice said severing area can be defined by (or comprise) a nip or cradle 25 for severing the web material. As will be clarified below, the web material is severed by insertion of the new winding core in this severing nip or cradle 25.

As shown in FIG. 1, during winding of a first roll L1 around a first winding core A1 the web material N is fed, according to the arrow fN, around the fourth winding roller 21, around the first winding roller 1 and winds on the roll L1 being formed which is retained, in this phase of the winding cycle, in the winding cradle defined by the three winding rollers 1, 3 and 7. The reference number 27 indicates a guide roller for the web material N positioned upstream of the winding head defined by the winding rollers 1, 3, 7 and 21.

Preferably the feed speed of the web material N is substantially constant. By substantially constant a speed is understood that varies slowly in relation to the winding speed and as a result of factors that are independent of the operations performed by the components of the winding head described above, which are controlled so that the winding cycle, unloading of the roll formed, insertion of the new core and starting of the winding of a new roll can be performed at constant feed speed of the web material towards the winding roller unit and in particular towards the fourth winding roller 21.

During the winding phase of the roll L1, outside the so-called exchange phase, which constitutes a transitory phase during operation of the machine, the peripheral speed of the winding rollers 1, 3, 7 and 21 is substantially the same and the various winding rollers all rotate in the same direction, as indicated by the arrows in the drawing. By substantially the same in this case a speed is meant, which can vary within the limit of the need to control the compactness of the winding and the tension of the web material N between the winding roller 21 and the winding roller 7, for example to compensate for the variation in tension which could be caused by displacement of the center of the roll being formed along the path between the winding rollers. In some embodiments this difference between peripheral speed of the rollers can be typically between 0.1 and 1% and preferably between 0.15 and 0.5%, for example between 0.2 and 0.3%, it being understood that said values are indicative and non-limiting.

In FIG. 1 the roll L1 in the winding cradle 1, 3, 7 has been practically completed with winding of the desired quantity of web material around the first winding core A1. A second winding core A2 has been provided in the terminal area of the core feeder 11. The reference letter C indicates a line or series of glue points applied on the outer surface of the second winding core A2. In some embodiments the glue C is positioned so that it does not come into contact with the push element 17B of the inserter 17 when the second winding core A2 is inserted towards the winding cradle. Preferably the glue C is applied along a continuous or discontinuous line, substantially parallel to the axis of the winding core.

Figure 2:
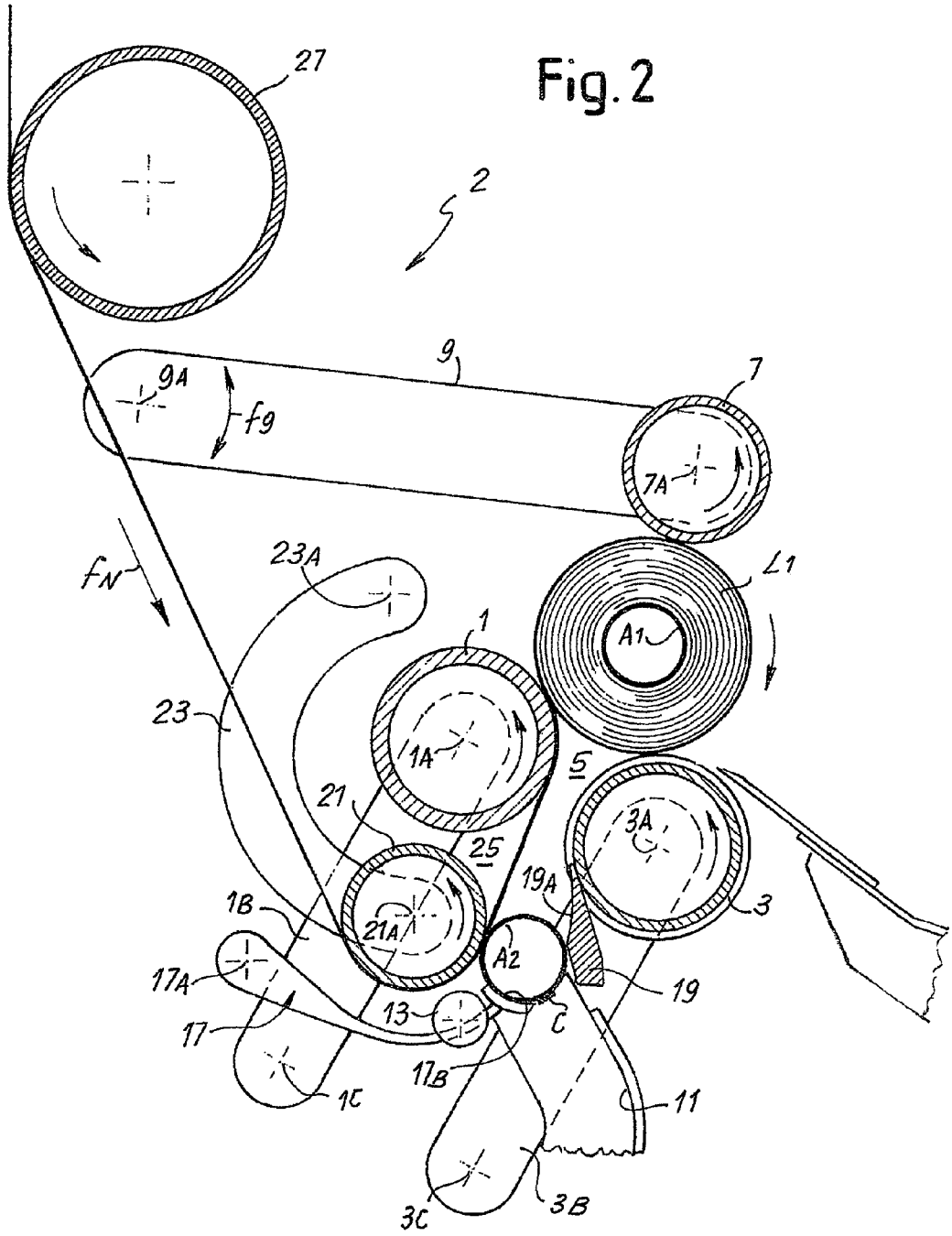

FIG. 2 shows the beginning of the subsequent exchange phase. The second core A2 is engaged by the inserter 17 and made to gradually advance towards an insertion channel 31 defined between the fourth winding roller 21 and the stationary plate 19 and more precisely the surface 19A of the latter. This surface 19A preferably has a concave shape, substantially parallel to the surface of the winding roller 21. As shown in particular in FIG. 2, in this phase the new winding core A2 is pressed against the fourth winding roller 21, pinching the web material N between the second winding core A2 and the cylindrical surface of the fourth winding roller 21. The distance between the surface 19A of the stationary plate 19 and the cylindrical surface of the fourth winding roller 21 is preferably less than the diameter of the winding core, at least in the initial section of the channel 31, so that the winding core is forcedly inserted in the channel 31. This is made possible by the nature of the material used to manufacture the winding core, typically cardboard, which allows a substantially elastic diametral deformation. The pressure with which the winding core A2 is pushed against the web material N and the cylindrical surface of the winding roller 21 arranged opposite thereto generates a friction force between the core and the surfaces with which it comes into contact (surface 19A and web material N supported by the winding roller 21), which causes an angular acceleration of the second winding core A2 due to the difference in speed between the surface 19A (fixed) and the web material N which advances at the feed speed. As a result of this, the second winding core A2 begins to roll on the surface 19A of the stationary plate 19 at a speed such that the axis of the winding core advances at a speed equal to half the feed speed of the web material. During this movement the core remains in contact with the fixed surface 19A of the stationary plate 19 and with the web material N pressed against the cylindrical surface of the fourth winding roller 21. The portion of surface 19B upstream of the portion of surface 19A serves as a lead for entry of the winding core into the channel 31.

Figure 3:
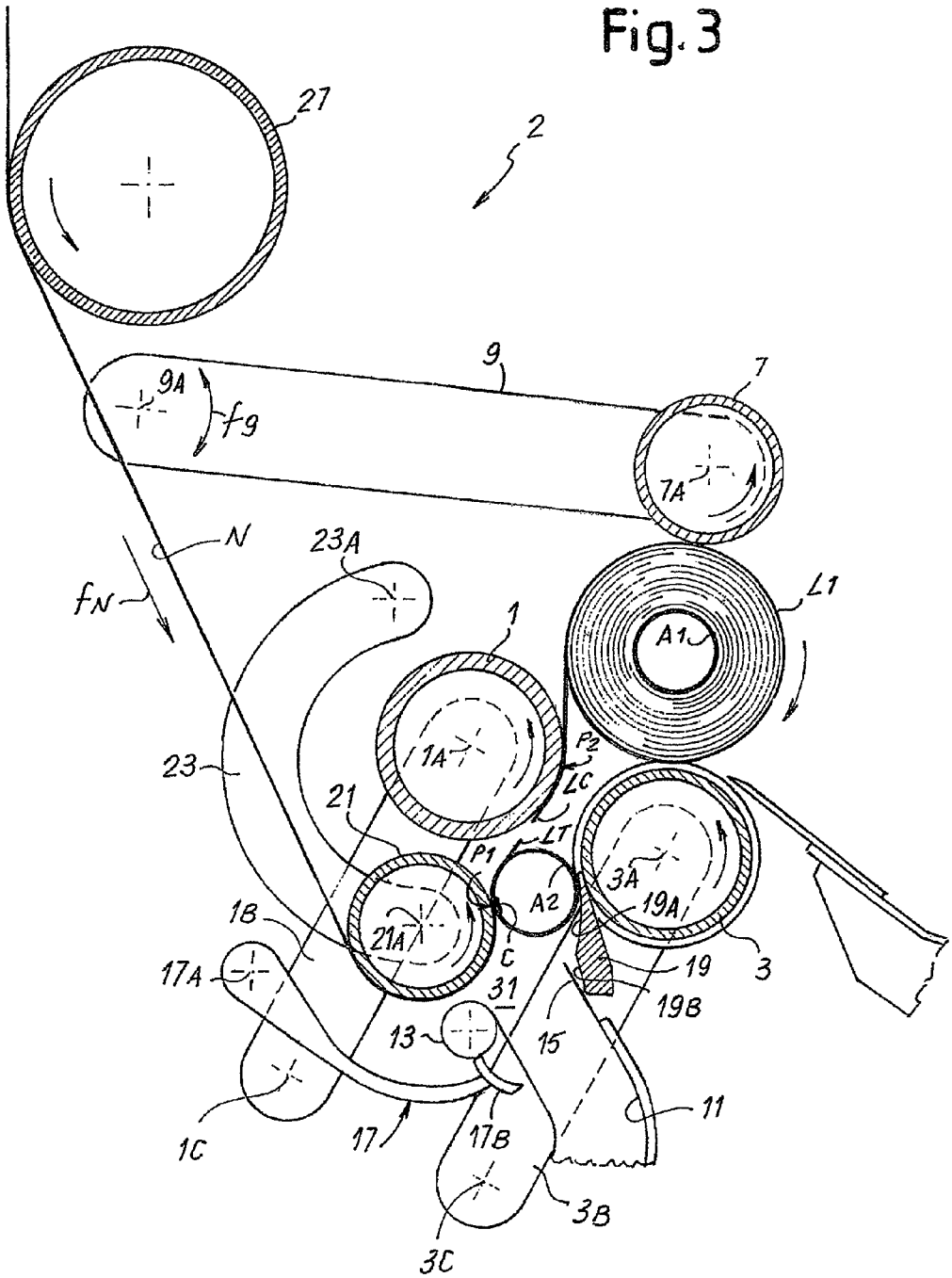

FIG. 3 shows the immediately following step, in which the second winding core A2, rolling on the second part of the surface 19A of the stationary plate 19, has come into contact with the cylindrical surface of the second winding roller 3. The reciprocal distance between the fourth winding roller 21 and the second winding roller 3 is variable and in this phase is slightly less than the diameter of the winding core A2, thus it remains pressed against the two winding rollers 21 and 3 so as to correctly maintain control of the core. The configuration and position of the stationary plate 19 and the winding rollers 3 and 21 can be chosen and adjusted so that the axis of the fourth winding roller 21 does not have to move when switching from the condition shown in FIG. 1 to the condition of FIG. 3.

The surface portion 19A of the stationary plate 19 is preferably concave and has a form and a position such that the space available for transit of the winding core is sufficiently limited to maintain a slight interference between core and parts 21, 19 of the machine.

As a result of the advancing movement by rolling of the core on the stationary plate 19 to the position of FIG. 3, the winding core A2 begins to roll towards the inside of the cradle 25 defined between the fourth winding roller 21 and the first winding roller 1. As a result of the interference between the winding core A2 and the roller 21 on one side, and the surface 19A of the stationary plate 19 on the other, the advancing movement by rolling of the core A2 remains controlled.

Advancing of the second winding core A2 towards and into the severing cradle defined between the winding rollers 1 and 21 causes a deformation of the path of the web material N. In FIGS. 1 and 2, in fact, the path of the web material N is straight and tangent to the winding rollers 1 and 21. As a result of advancing of the second winding core A2, however, the web material is pushed inside the severing cradle 25, with a consequent increase in the length of the path of the web material between the pinching point of the web material by the core A2 against the fourth winding roller 21 and the point of tangency of the web material N on the first winding roller 1. This lengthening of the path causes an elastic lengthening of the web material, since the speed of the winding rollers 1 and 21 remains substantially constant and equal to the feed and advancing speed of the web material N.

Continuing the rolling of the winding core A2 and therefore lengthening of the path of the web material. N, the latter will reach the condition of maximum lengthening and will tear, forming a trailing edge LC of the first roll L1 completed around the first winding core A1 and a leading edge LT of the beginning of winding of a second roll L2 around the second winding core A2. As a result of the rolling and advancing of the second winding core A2, the glue line C applied on the outer surface of the second winding core A2 is in this phase in the area in which the web material N is pinched between the second winding core A2 and the fourth winding roller 21. In this way the initial portion terminating in the leading edge LT of the web material N just severed due to the lengthening described above is anchored to the second winding core A2.

Figure 4:
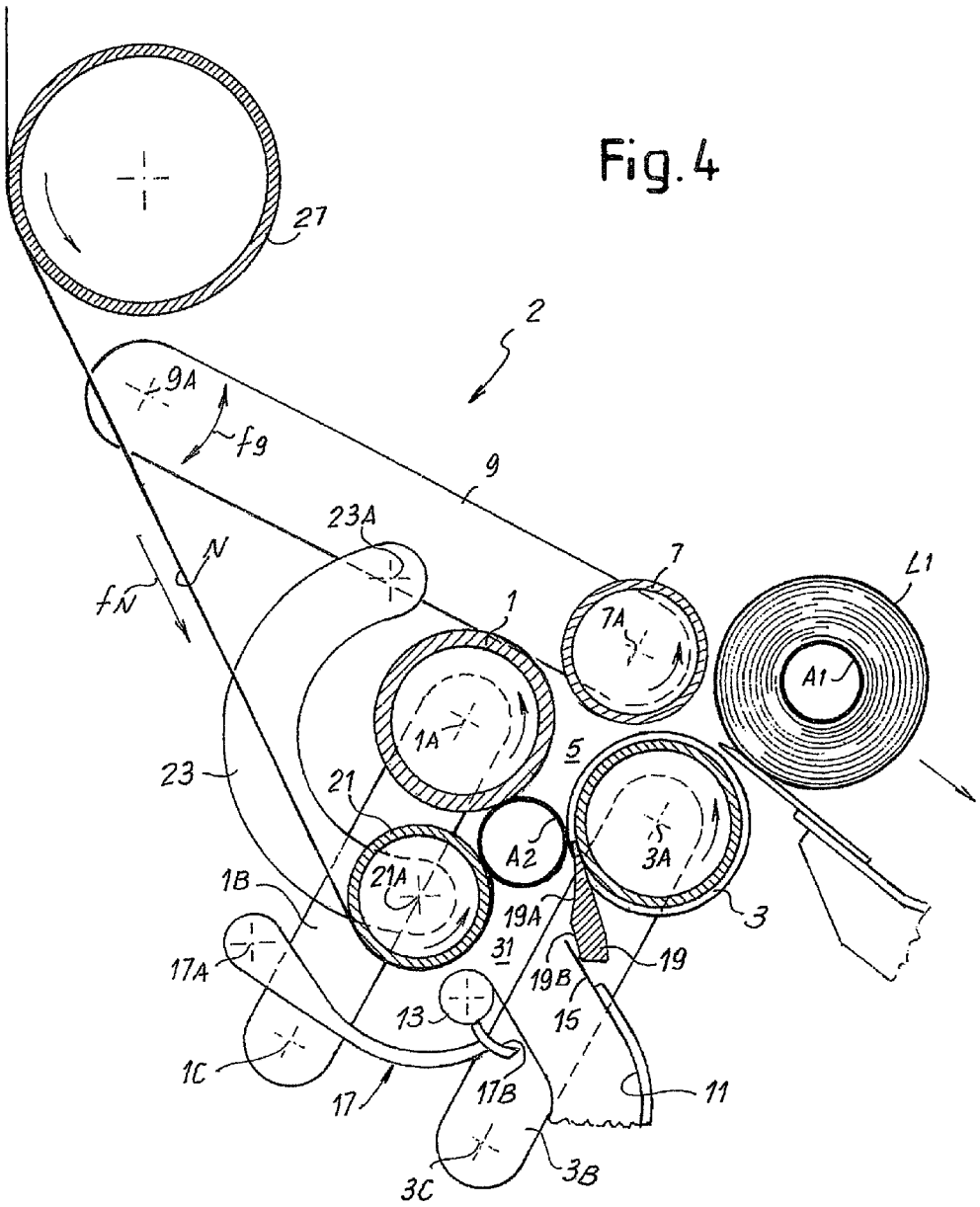

In the subsequent FIG. 4 the second winding core A2 has continued its advancing movement, losing contact with the stationary plate 19 and coming into contact with the first winding roller 1. In this phase, therefore, the second winding core A2 is in a winding cradle defined by the three rollers 1, 3, 21. Since in this phase the three rollers rotate substantially at the same angular velocity, the core A2 remains in this position rotating around its own axis so that one or more loops of web material form around it. The stay time of the second winding core A2 in the position of FIG. 4 can be controlled by simply adjusting the peripheral speed of the winding rollers 1, 3 and 21. The second winding core A2 will remain substantially in this position, without advancing further, for as long as the peripheral speed of the winding rollers 1, 3 and 21 remains the same. The next advancement is obtained for example by decelerating the second winding roller 3 as described below. It is therefore possible to set as required the quantity of web material N which winds around the winding core A2 by retaining the latter and the second roll L2 that forms around it in the winding cradle 1, 3, 21 for the desired time.

Figure 5:
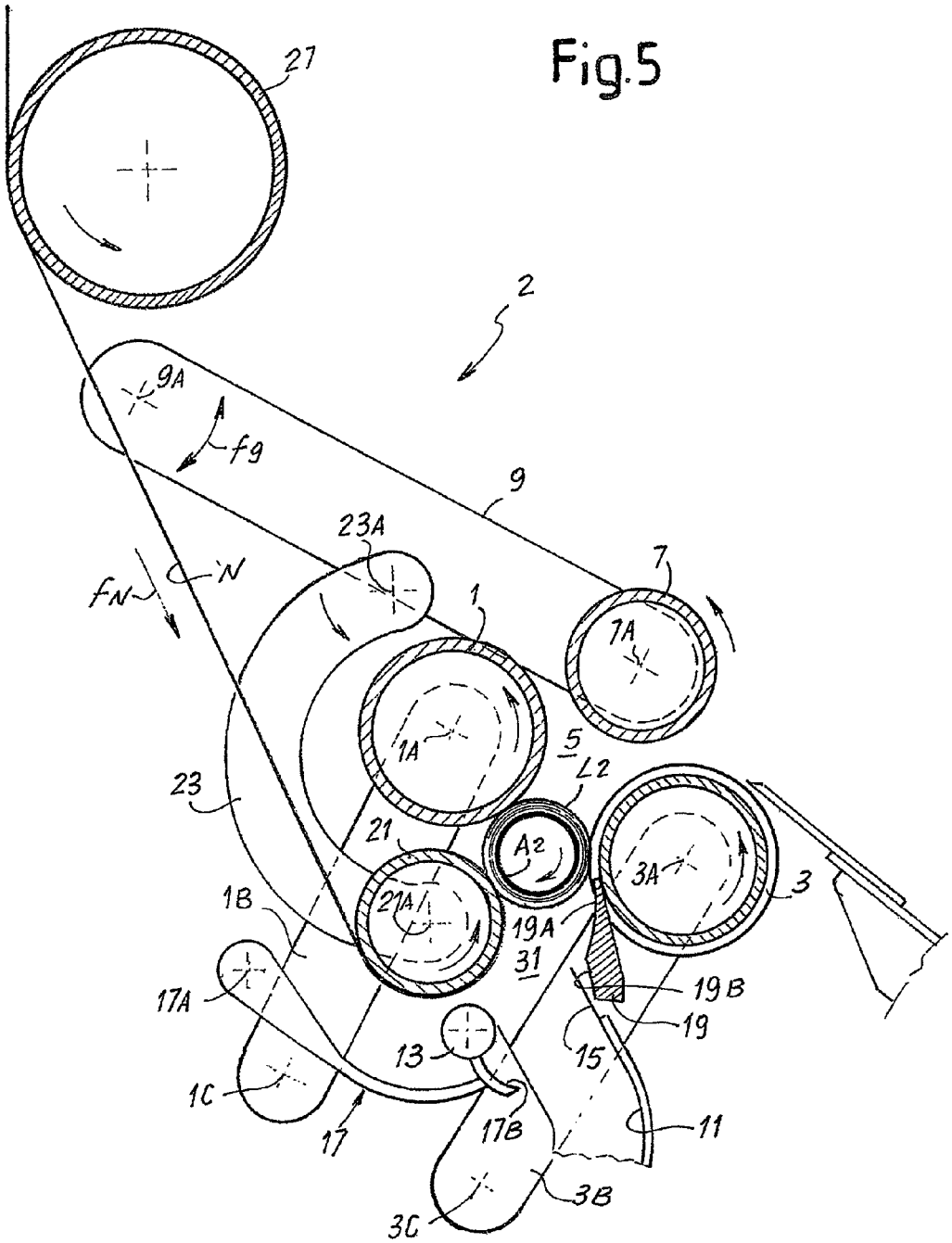
Figure 6:
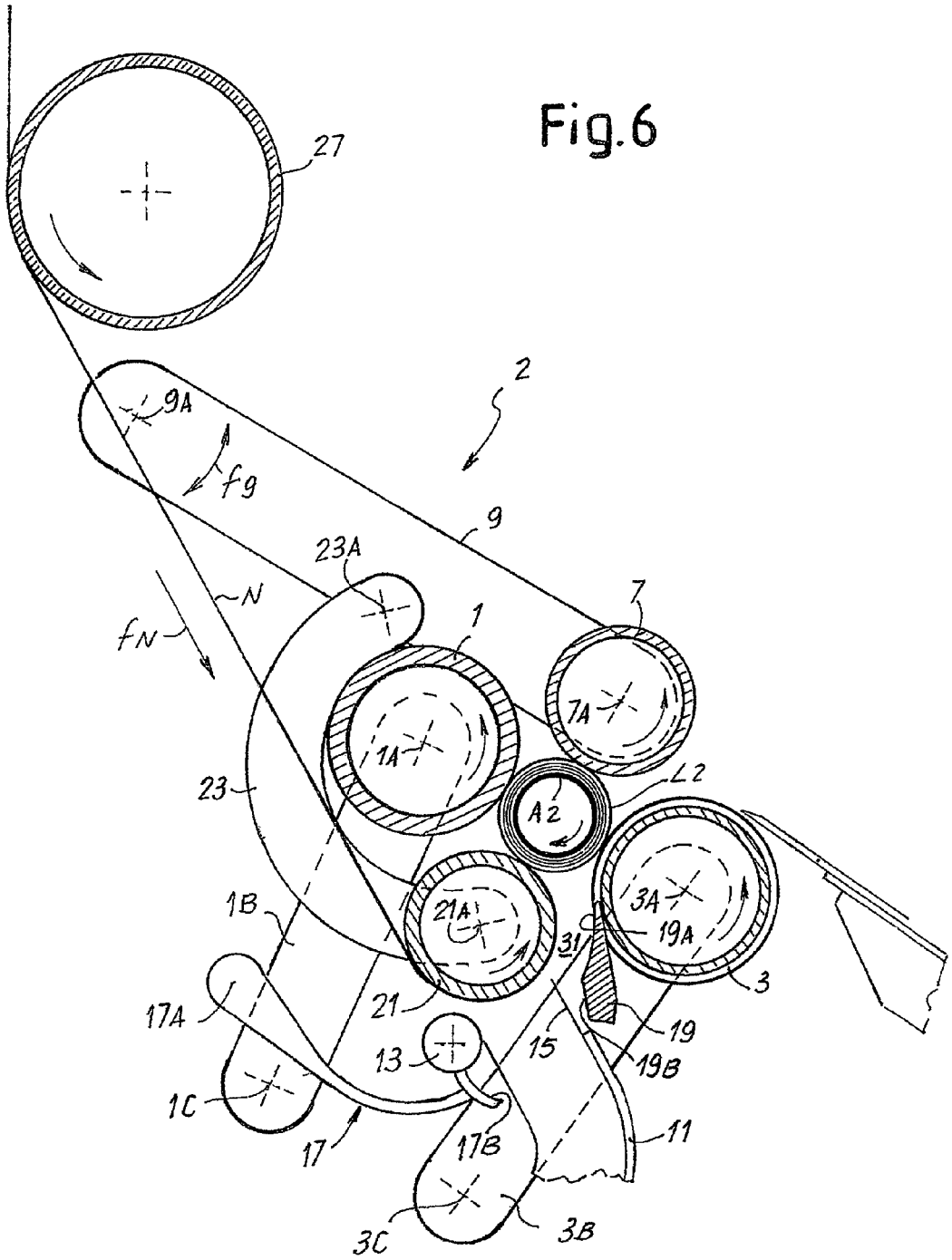

FIG. 5 shows the next phase in the winding cycle. The second winding core A2 on which the second log or roll L2 is forming must be transferred from the area upstream of the nip 5 to the area downstream of said nip, i.e. from the winding cradle defined by the first winding roller 1, by the second winding roller 3 and by the fourth winding roller 21, towards and into the winding cradle defined by the first winding roller 1, by the second winding roller 3 and by the third winding roller 7.

For said purpose, as can be seen in FIG. 5, the first winding roller and the second winding roller 3 move away from each other, in a controlled manner according to the advancing speed of the winding core A2 and the feed speed of the web material N. This is because the higher the feed speed of the web material, the higher the speed at which the diameter of the second roll L2 forming around the second winding core A2 increases. Furthermore, the lower the advancing speed of the core A2, the greater the increase in diameter of the second roll L2. As mentioned, the advancing movement of the core A2 and the roll L2 during winding around it is obtained by modifying the peripheral speed of the winding rollers. More specifically, in the example illustrated, the second winding roller 3 is slowed down so that the second winding core A2 begins to roll through the winding nip 5 with the advancing speed of the axis of the core A2 equal to half the difference between the peripheral speeds of the first winding roller 1 and the second winding roller 3.

In view of the fact that the winding core has received a certain quantity of web material N and therefore the roll or log L2 has already partly formed around it, the distance between the winding rollers 1, 3 is increased to allow the passage of the new roll L2 being formed.

In some preferred embodiments of the invention, as illustrated, the reciprocal spacing, i.e. moving away from each other of axes 1A and 3A of the first winding roller 1 and the second winding roller 3, is performed by moving the two winding rollers 1 and 3 symmetrically and synchronously. For said purpose the winding rollers 1 and 3 are each supported by a pair of arms indicated respectively by 1B and 3B in the drawing. The arms 1B and 3B are hinged around pivoting axes 1C and 3C. Suitable actuators, not shown, for example in the form of electronically controlled electric motors, drive the movement of the rollers away from each other and then back again. Similar actuators can be used to control also the movements of the axes 7A and 21A of the other winding rollers 7 and 21.

While the core A2 with the second roll L2 being formed around it advances through the winding nip 5 due to the difference in peripheral speed of the first winding roller 1 and the second winding roller 3, the fourth winding roller 21 is shifted forward by pivoting the pair of arms 23 around the pivoting axis 23A to accompany the core A2 and the roll L2 in the movement through the winding nip 5. In this way during all, this phase of the winding cycle, the new roll L2 being formed around the second winding core A2 remains constantly in contact with the three rollers 1, 3, 21.

The gradual advancing movement of the second winding core A2 and the second roll L2 through the winding nip 5 (FIG. 6) brings the second roll L2 into contact with the cylindrical surface of the third winding roller 7, which in the meantime has moved closer to the winding nip 5 after the first roll L1 has been unloaded from the winding cradle defined by the winding rollers 1, 3 and 7, as can be seen in the sequence of FIGS. 3 and 4. This unloading movement is obtained in a per se known manner by adjusting the peripheral speeds of the winding roller 3 and/or of the winding roller 7, so that the peripheral speed of the winding roller 7 is temporarily higher than the peripheral speed of the winding roller 3.

Since the latter is in any case decelerated to allow advancing of the second winding roller A2 through the winding nip 5, the third winding roller 7 could be maintained at a constant peripheral speed. However, in order to speed up unloading of the roll L1 formed during the preceding cycle, it may be advantageous to accelerate also the winding roller 7, obtaining a greater difference between peripheral speed of the winding roller 7 and peripheral speed of the winding roller 3. Acceleration of the third winding roller 7 also provides the further advantage of tensioning the web material N before the tearing or severing phase (FIG. 3) if said acceleration begins slightly before the phase of insertion of the second winding core A2 in the severing cradle 25.

Returning to FIG. 6, it is observed that at this moment the second winding core A2 with the roll L2 being formed around it is instantaneously in touch with all four winding rollers 1, 3, 7 and 21.

Figure 7:
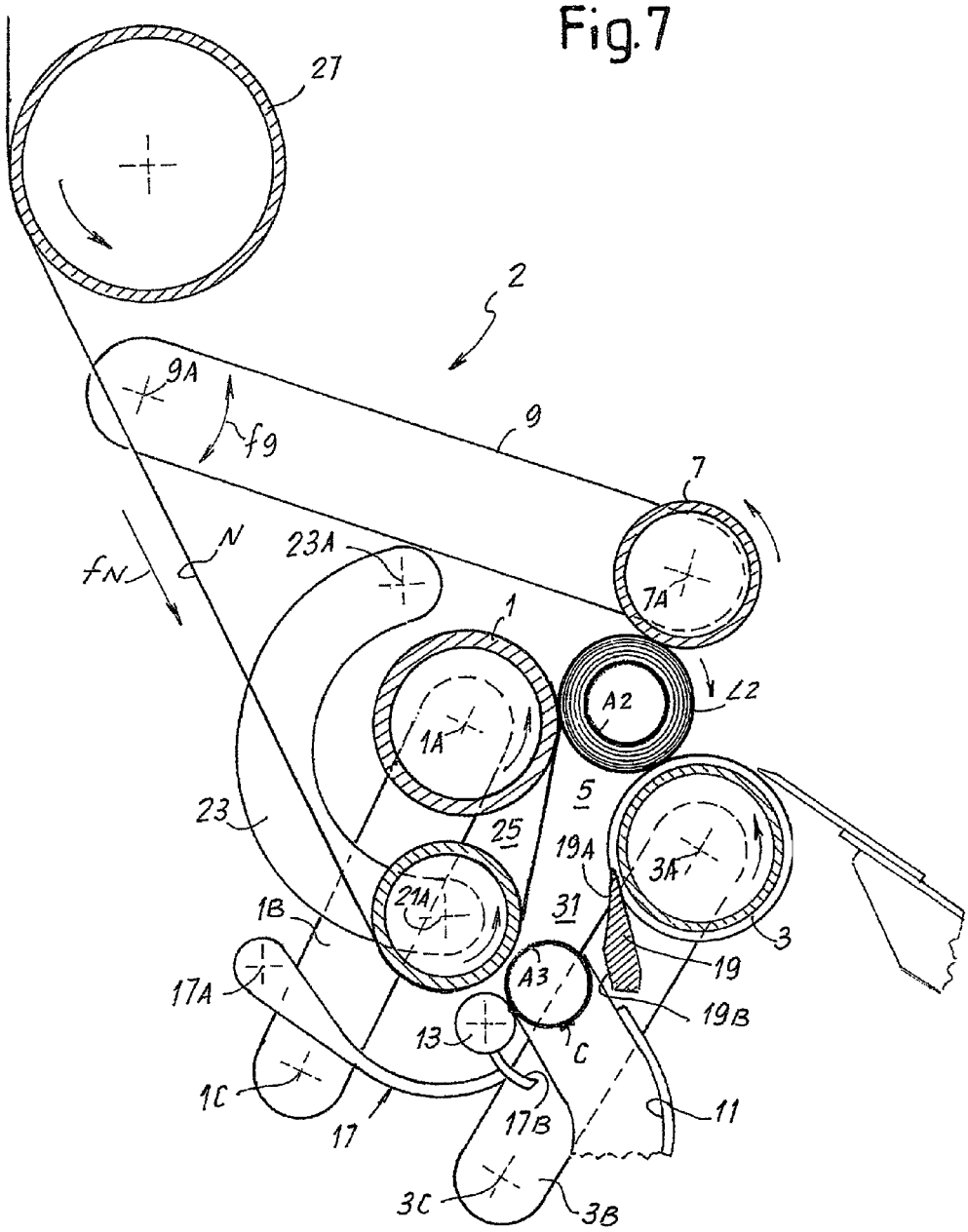

The winding cycle continues, still maintaining the difference in peripheral speed between the winding roller 1 and the winding roller 3, until the new core A2 is completely positioned in the winding cradle defined by the rollers 1, 3, 7 as shown in FIG. 7. This further transit phase of the second winding core A2 from the midline of the winding nip 5 inside the winding cradle 1, 3, 7 is accomplished after moving away the second roll L2 being formed by the fourth winding roller 21, which can reset to its initial position corresponding to that of FIG. 1, as can be seen in FIG. 7, where a third winding core A3 is also illustrated which has been positioned in the feeder 11 to start the next switchover cycle.

Figure 8:
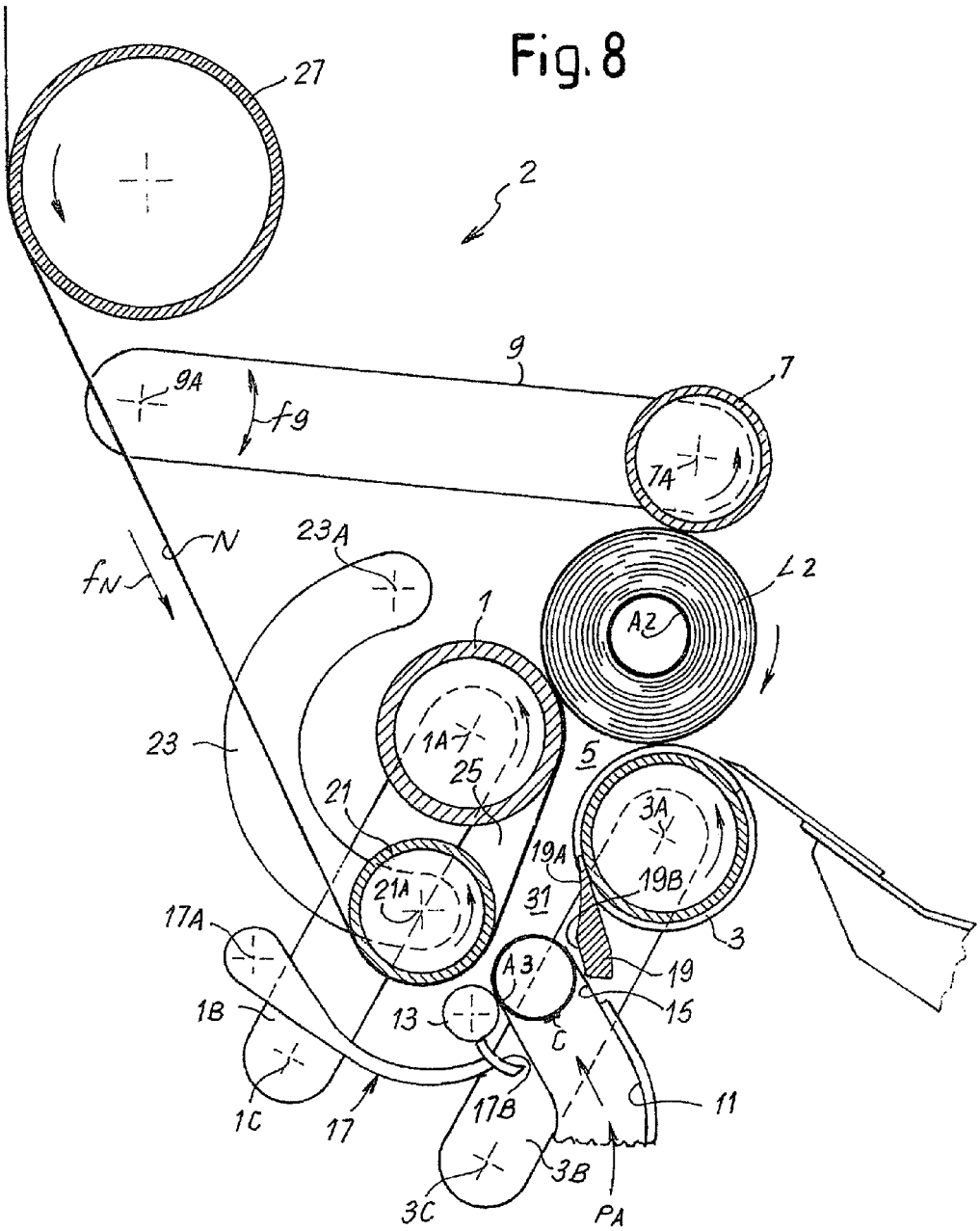
Figure 9:
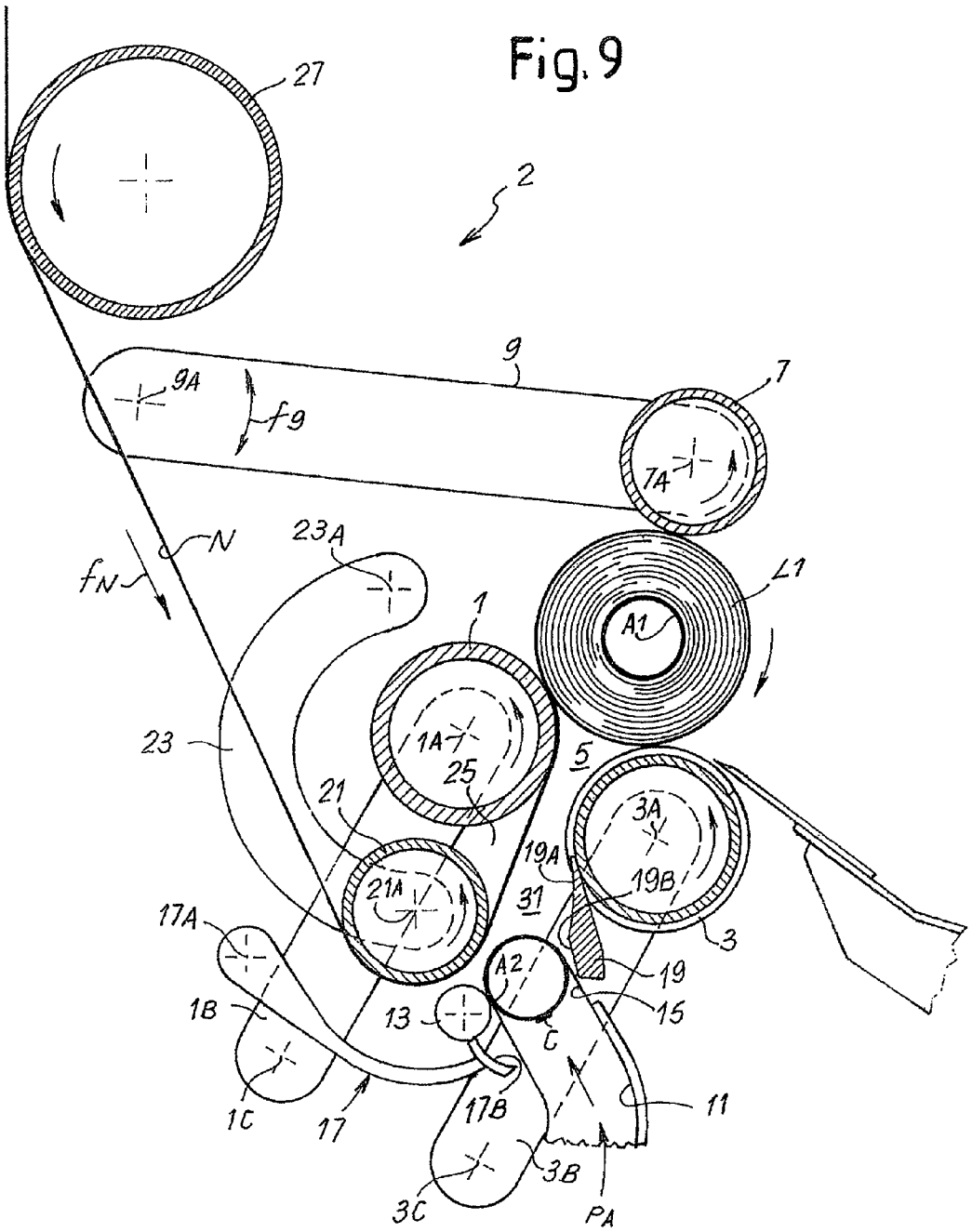
FIGS. 9 to 16 show a second embodiment of the rewinding machine according to the invention and an operating sequence of said machine.
Figure 10:
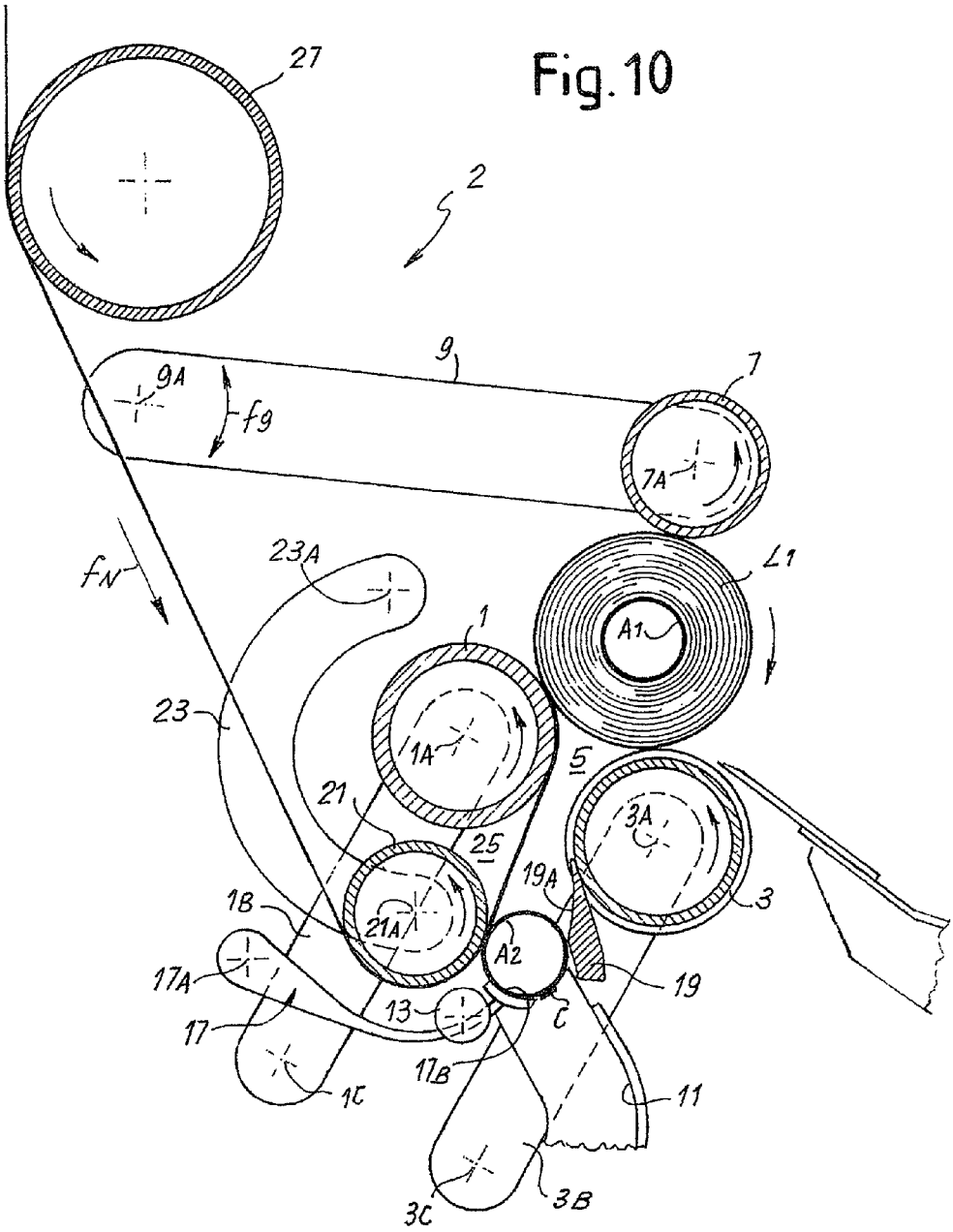
Figure 11:
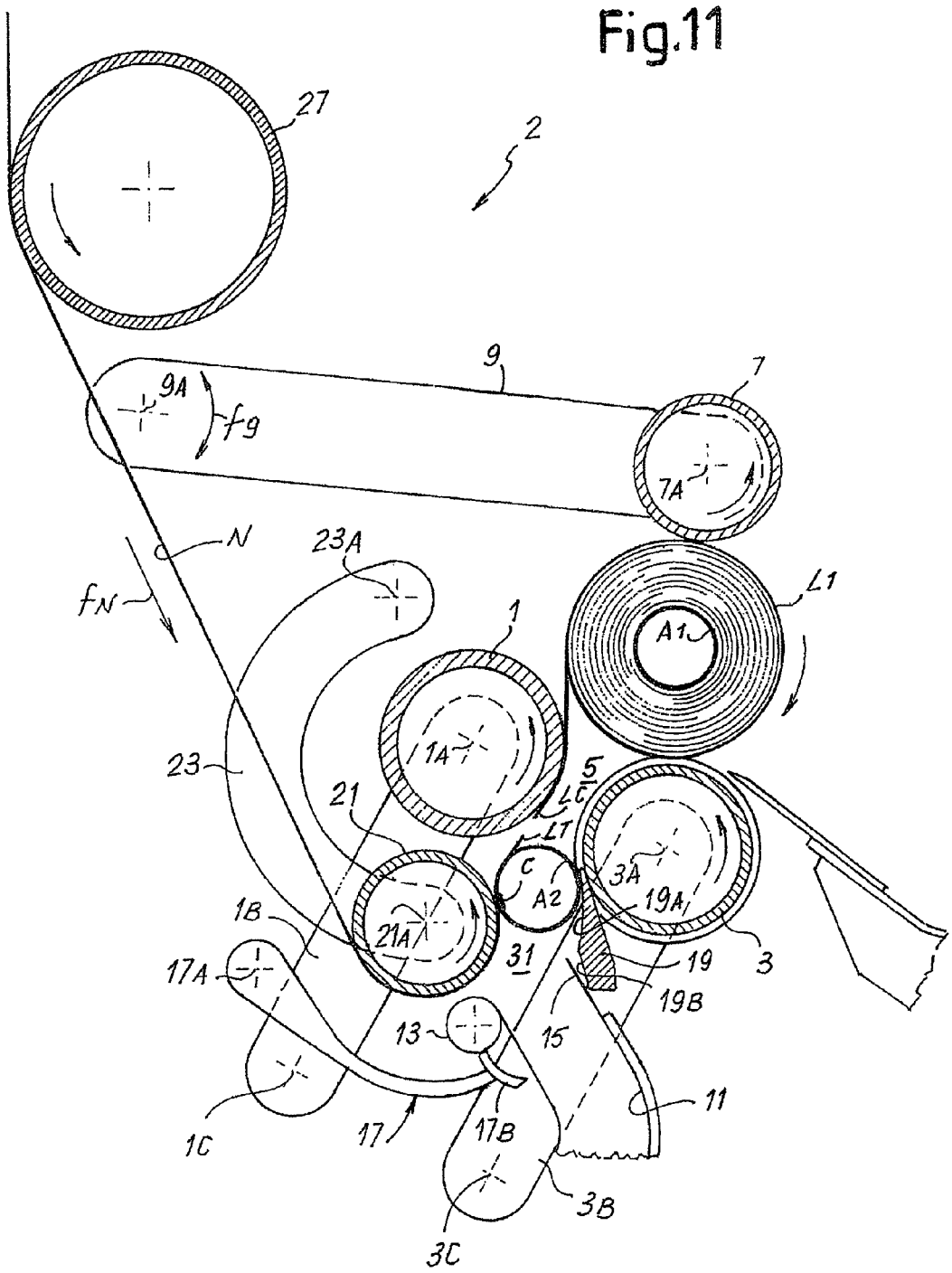
Figure 12:
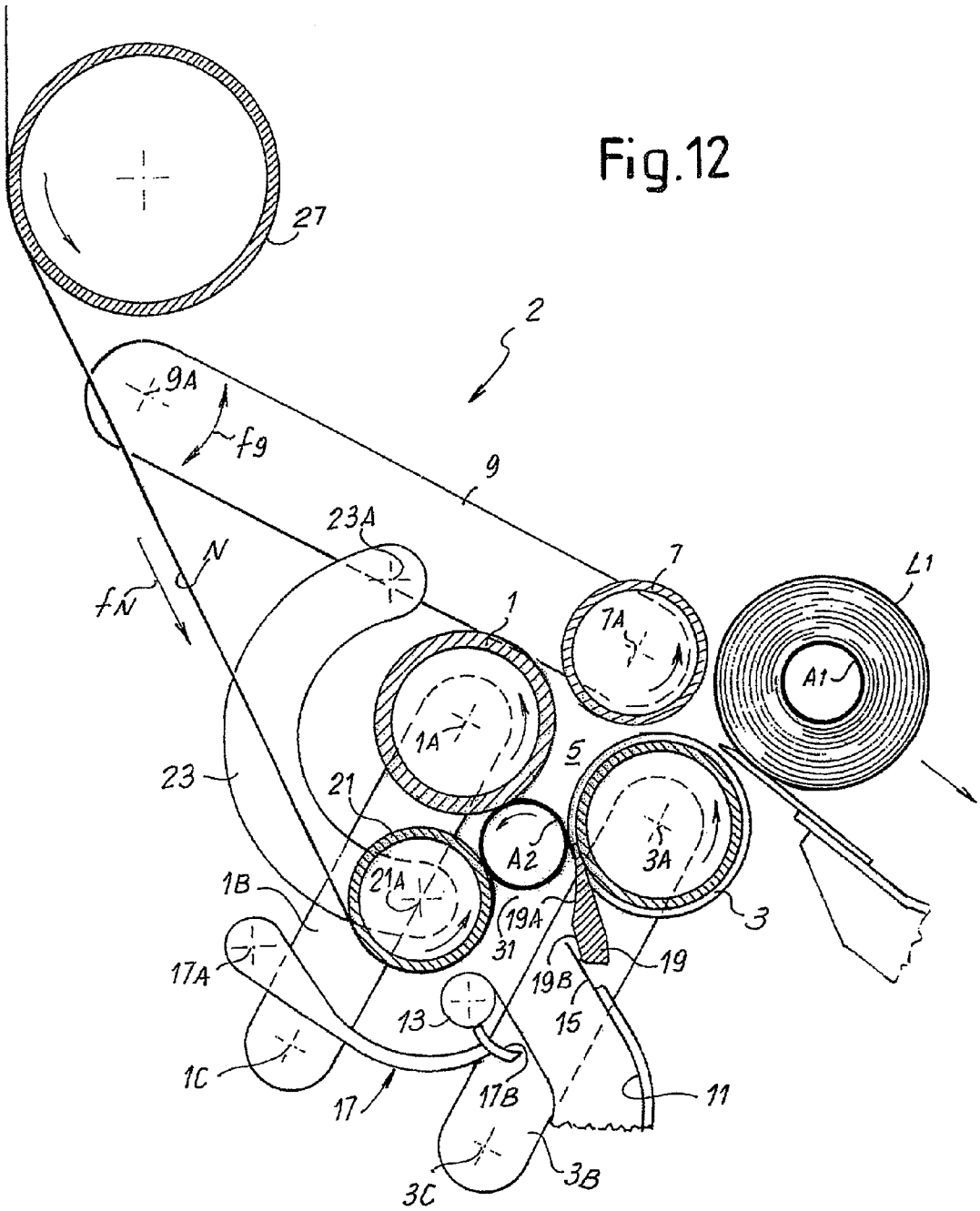
Figure 13:
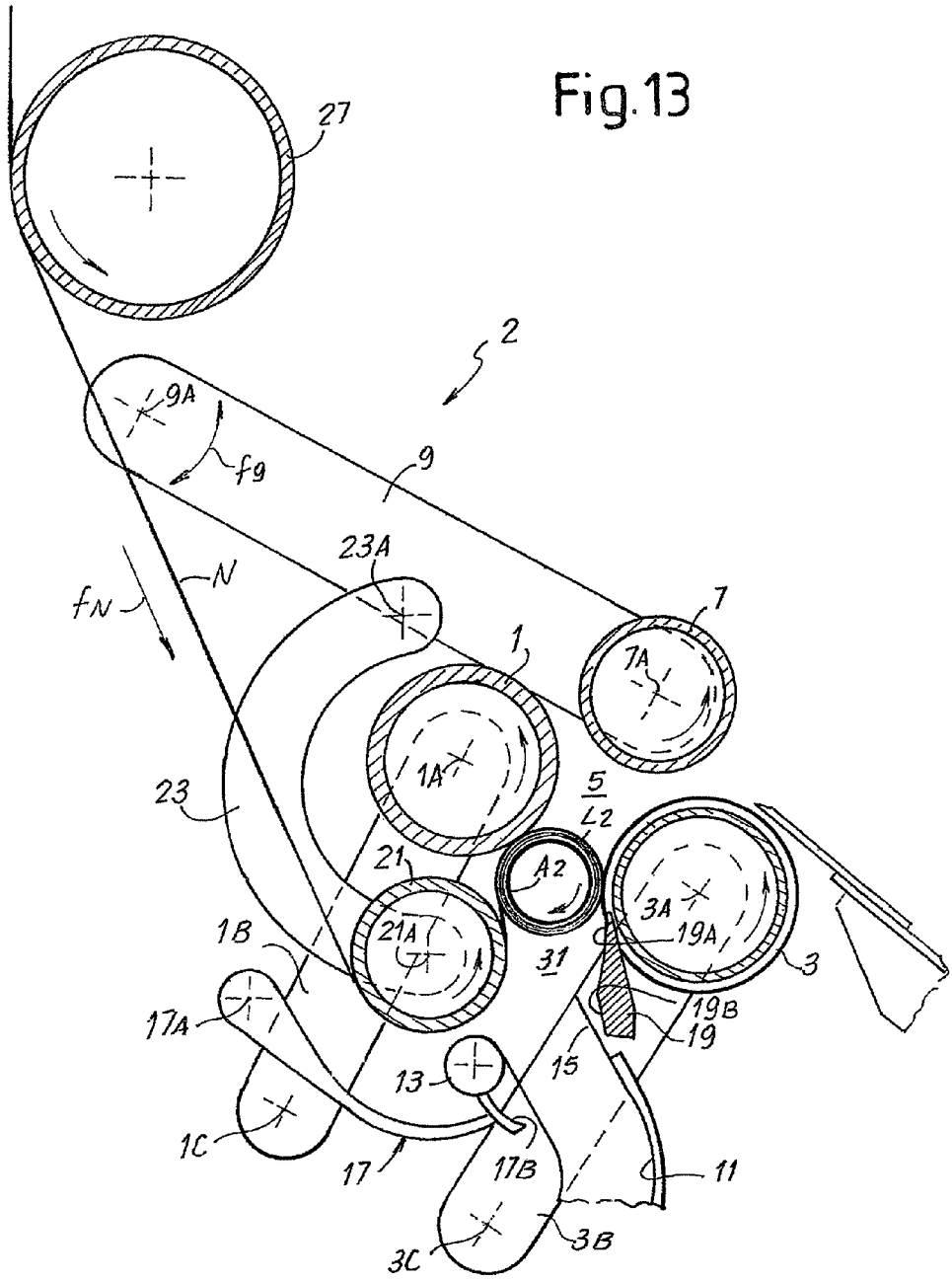
Figure 14:
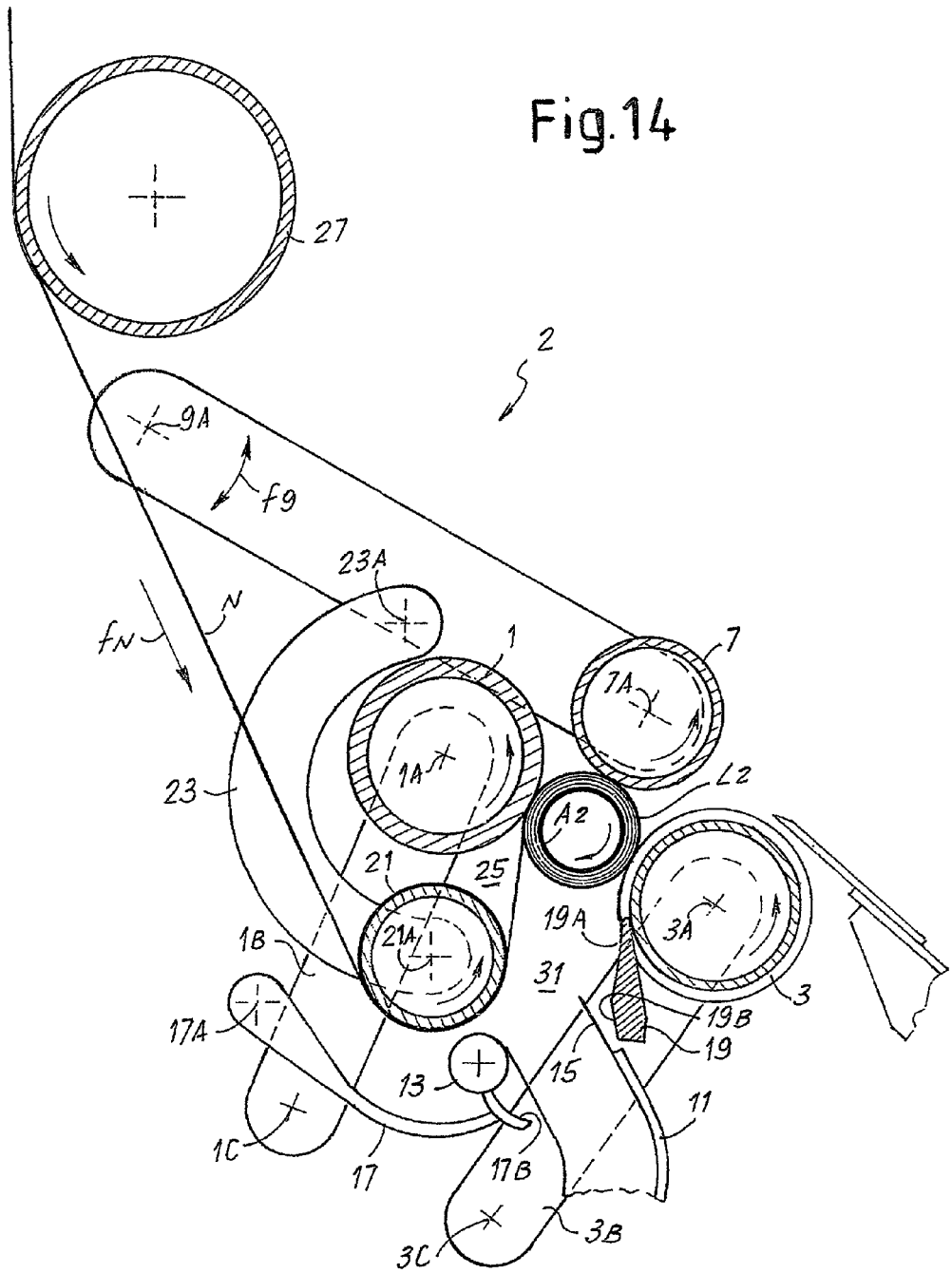
Figure 15:
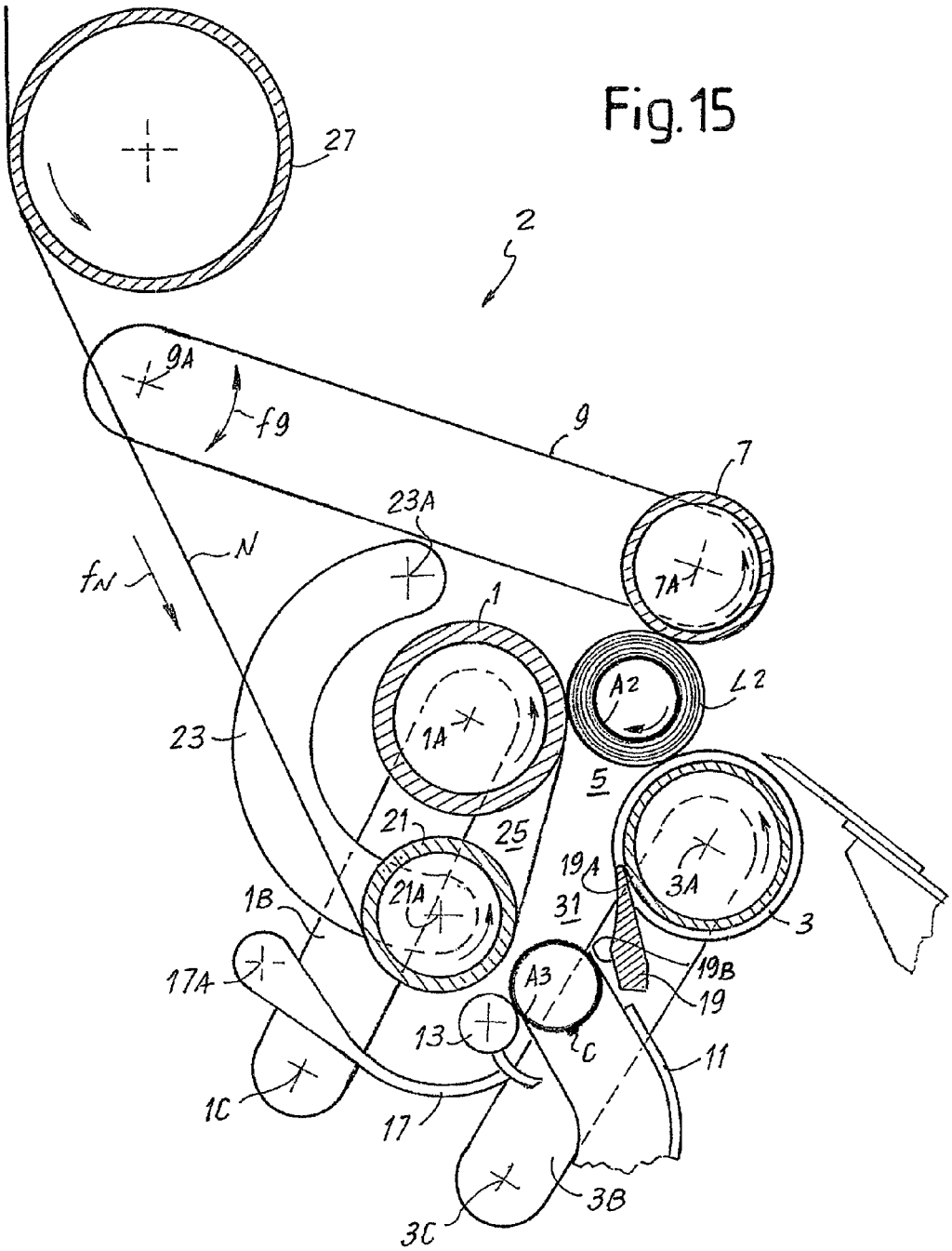
Figure 16:
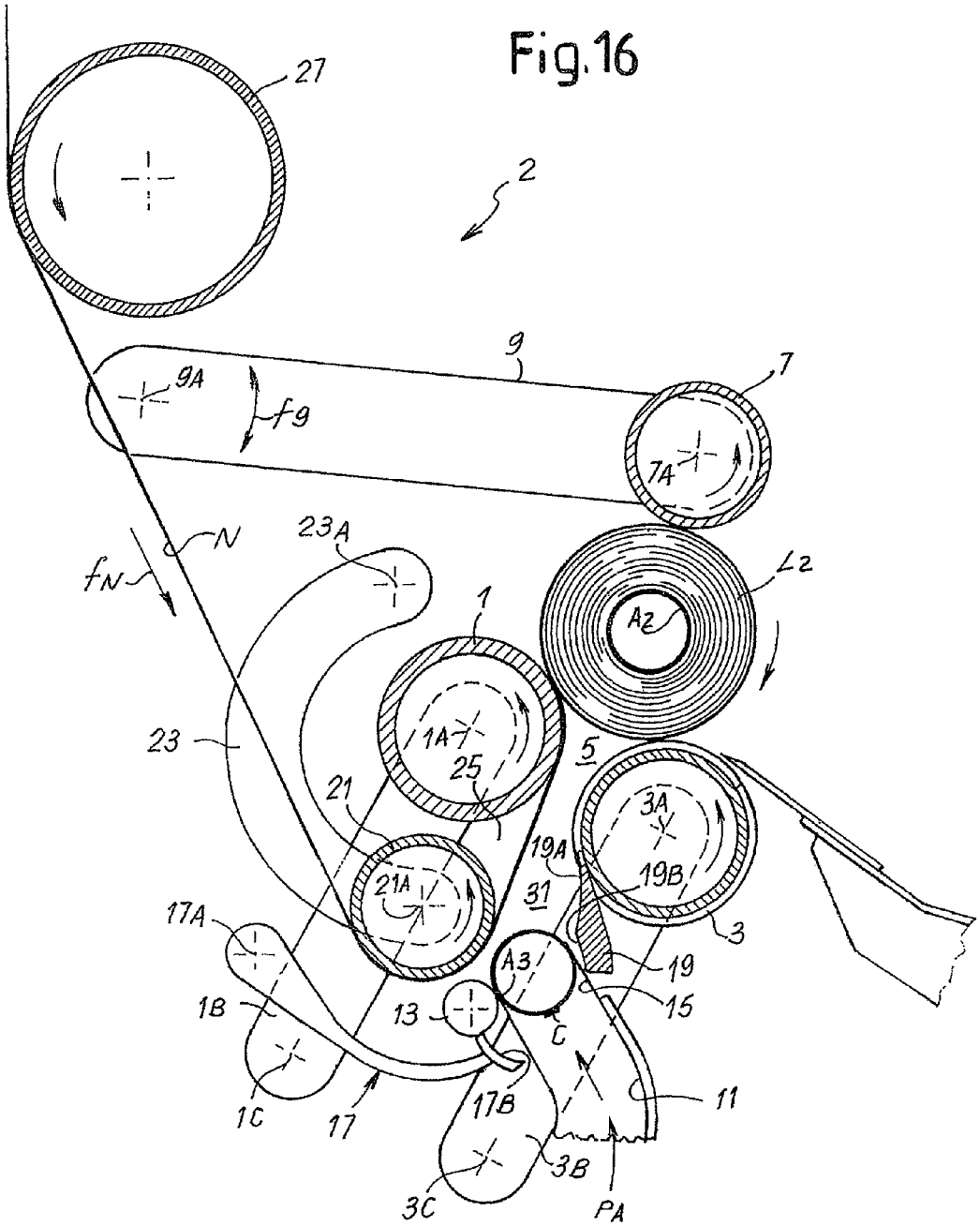

FIG. 8 shows the final winding phase of the second roll L2 around the second core A2, a phase in which the machine is in the same position as the one illustrated in FIG. 1.

The configuration of the parts of the rewinding machine illustrated in FIGS. 1-8 is such that the path followed by the center of the winding cores A1, A2 from the moment they come into contact with the two rollers 1, 3 to the moment when the roll begins to be unloaded between the rollers 3 and 7, losing contact with the roller 1, is substantially straight. This allows more regular winding and facilitates the use of tailstocks which can be inserted in the opposite ends of the winding cores in order to improve control of the rotation and advancing movement of the core and roll during the winding cycle, combining the technique of peripheral winding with an axial or central winding, as described for example in the U.S. Pat. No. 7,775,476 and in the publication US-A-2007/0176039.

FIGS. 9 to 16 show a modified embodiment of the rewinding machine according to the invention. The same reference numbers indicate parts which are identical or equivalent to those described with reference to FIGS. 1 to 8 and will not be described again. In this embodiment the axis 21A of the fourth winding roller 21 is kept in a substantially fixed position, so that the new winding core A2 performs a part of its movement (FIGS. 13 and 14) keeping in contact with only the first and second winding roller 1 and 3, instead of with three winding rollers. This constitutes substantially the only difference between the embodiment of FIGS. 9 to 16 and the embodiment of FIGS. 1 to 8, while the method with which the web material is severed in the two cases remains substantially the same.

The embodiment of FIGS. 9 to 16 has greater construction and control simplicity, since it is not necessary to perform a cyclic pivoting movement of the fourth winding roller 21 around the pivoting axis 23A of the arms 23, which results in a simpler and cheaper configuration. The initial part of the winding is performed in contact with only two winding rollers, i.e. rollers 1 and 3, as in the traditional machines.

Figure 17:
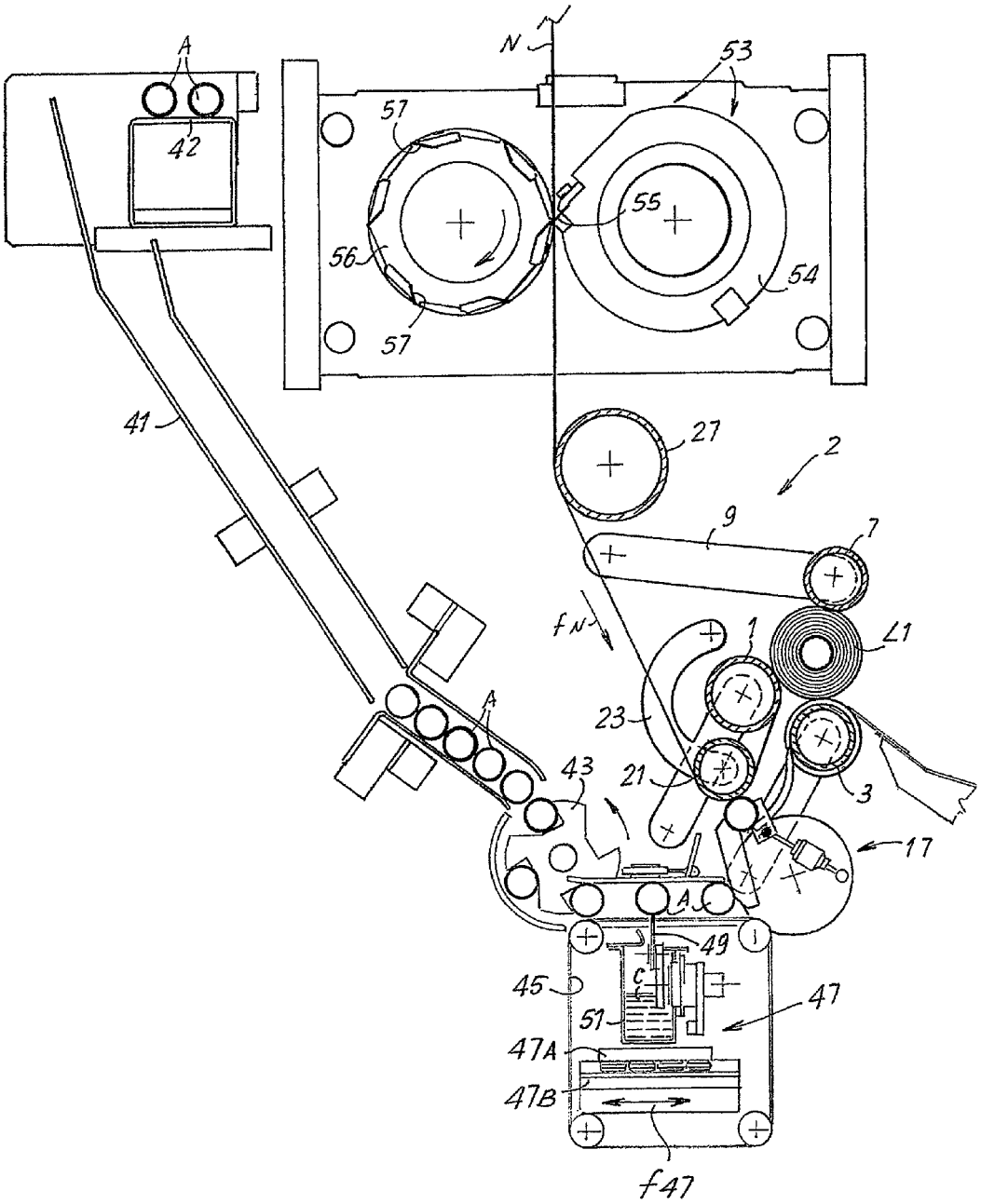
FIG. 17 shows a schematic view of a rewinding machine in a further embodiment.
Figure 18:
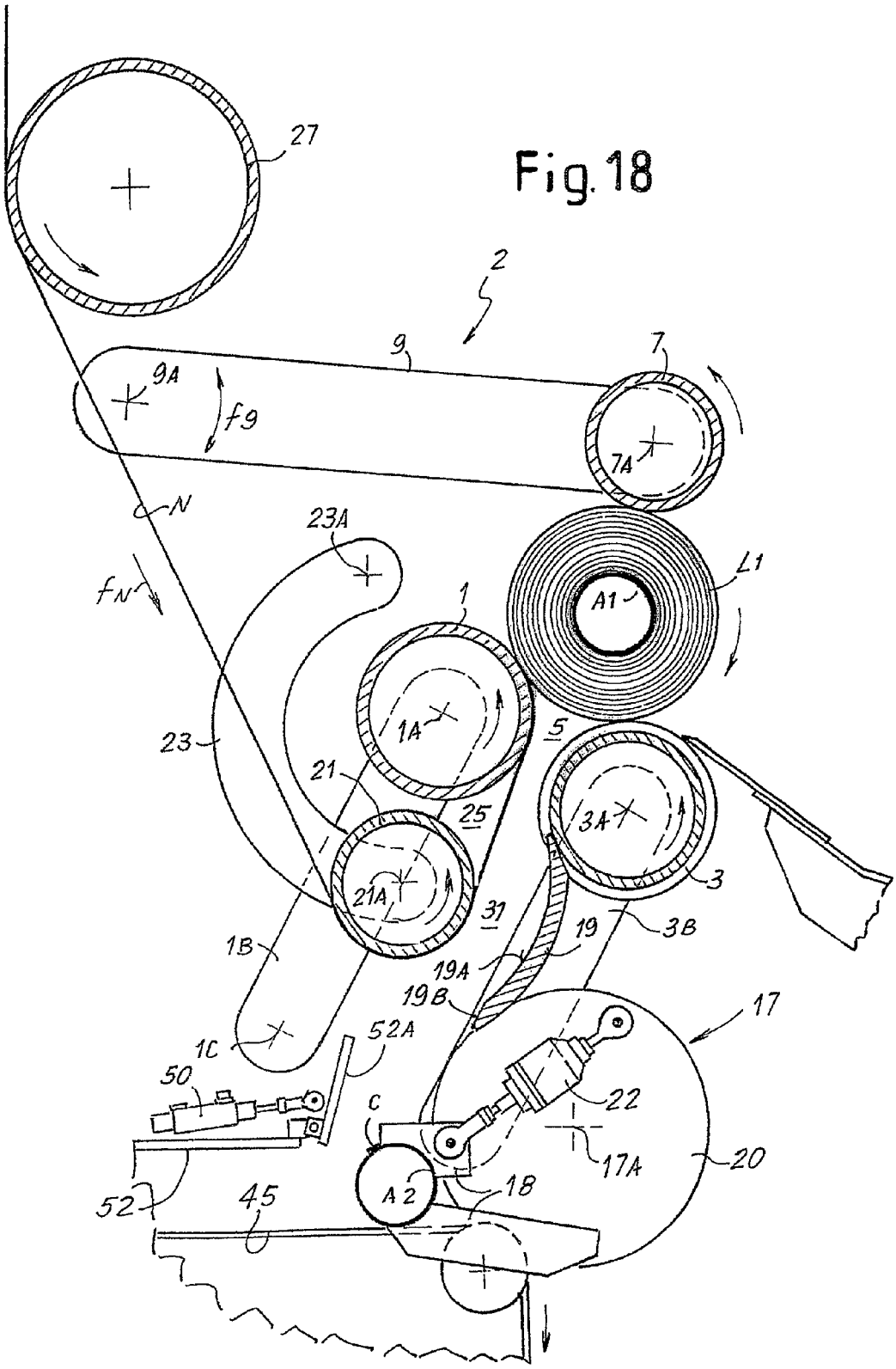
FIGS. 18 to 25 show an operating sequence of the rewinding machine of FIG. 17.
Figure 19:
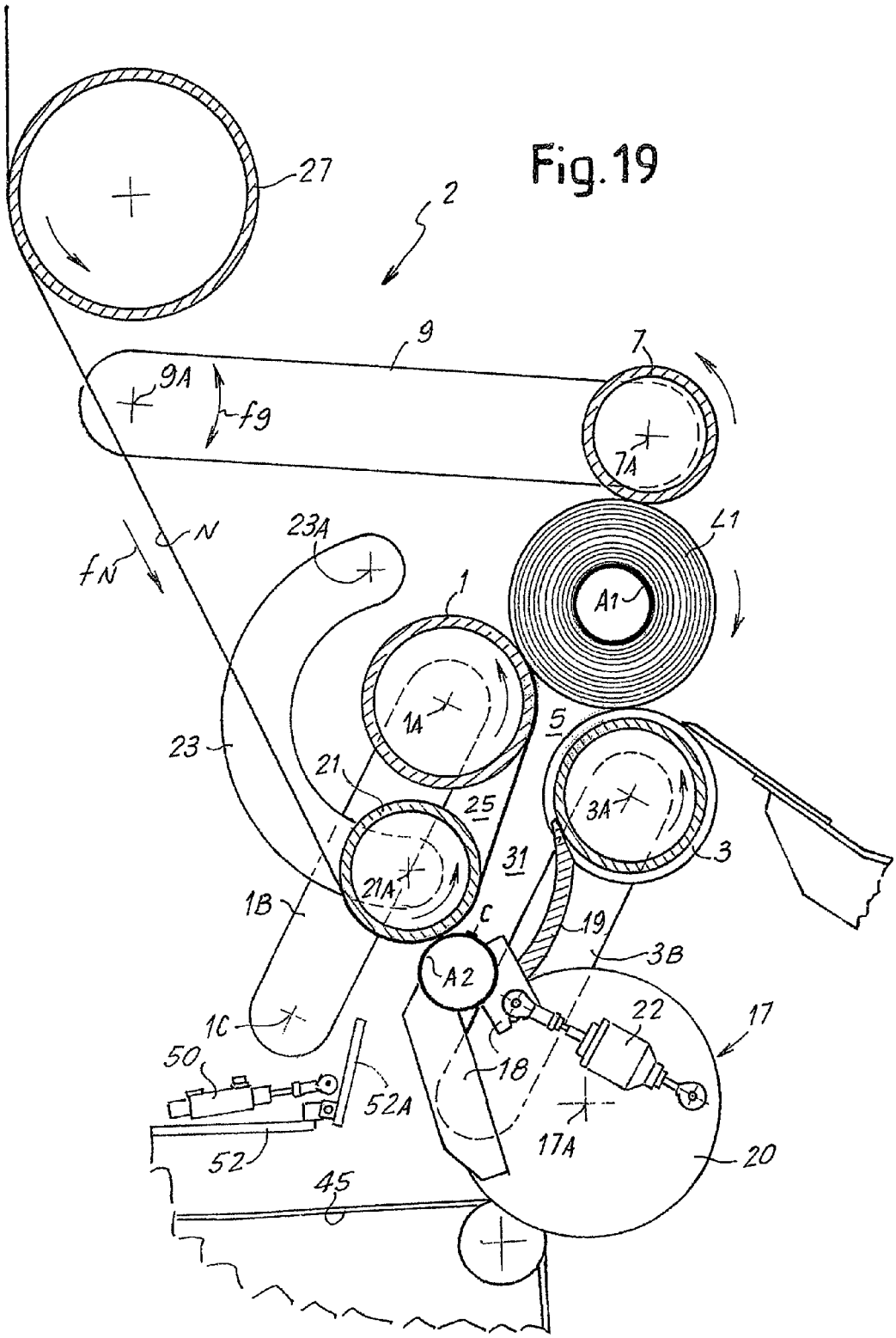

FIG. 17 shows a further embodiment of a rewinding machine according to the invention, the operation of which is illustrated in the sequence of the successive FIGS. 18 to 25. In FIGS. 17 to 25 identical numbers indicate parts that are identical or corresponding to those of FIGS. 1 to 16.

The rewinding machine 2 of FIGS. 17 to 25 differs from the rewinding machine of FIGS. 1 to 8 mainly due to the different structure of the winding core feeder and inserter 17 and due to the different form of the stationary plate 19. The operating method of the machine can be substantially equal to the one described with reference to FIGS. 1 to 8 or to the one described with reference to FIGS. 9 to 16. The sequence of FIGS. 18 to 25 shows an operating method corresponding to that of FIGS. 1 to 8, i.e. in which the fourth winding roller 21 is movable cyclically during the formation of each roll or log of web material, thus maintaining the roll or log L1, L2 always in contact with at least three winding rollers.

FIG. 17 shows some components of the rewinding machine not shown in FIGS. 1 to 16 and in particular: the conveying system of the winding cores towards the winding head, the core gluing unit and a perforator for perforating the web material N according to substantially equidistant transverse perforation lines, which divide the material into sheets detachable at the moment of use by tearing along the perforation line.

In the example illustrated, the winding cores are conveyed downwards by gravity along a descending channel 41 by a conveyor belt 42 on which winding cores A arrive for example from a core winder, not shown. A rotating distributor 43 individually collects the cores A coming from the descending channel 41 and transfers them to a conveyor 45 which transfers the individual winding cores A, A1, A2 through a gluing unit 47. The cores A, A1, A2 can be conveyed towards the gluing unit in any other suitable manner.

In this embodiment the gluing unit 47 comprises a movable element 49 for lifting the glue from a container below 51. The glue is applied while the winding core A is advanced by the conveyor 45 along a path defined between the upper branch of the conveyor 45 and a counter surface 52, the final part 52A of which is moved by an actuator 50 to allow collection of the individual cores by the inserter 17. To obtain greater accuracy and precision in glue application, the conveyor 45 is controlled in order to temporarily stop the winding core A in a position above the movable element 49, which is raised to apply a line of glue on the cylindrical surface of the temporarily stopped winding core. The line can be a continuous or a discontinuous line, for example consisting of an alignment of glue spots arranged roughly parallel to the axis of the winding core. Once the movable element has lost contact with the surface of the winding core, the latter again begins to advance towards the winding cradle.

The structure of this type of gluing unit is known per se and will not be described in further detail. The glue C can be applied also with other types of gluing unit known to persons skilled in the art. It should be noted, moreover, that in the example illustrated, the gluing unit is mounted on a slide 47A, the position of which can be adjusted according to the double arrow f47 along guides 47B. This adjustment is useful for ensuring that the line of glue applied to the winding cores is in the most appropriate angular position when the winding core comes into contact with the web material N.

The winding cores provided with glue C are collected individually by the inserter 17, which in this embodiment comprises a gripper 18 supported by an element 20 rotating or pivoting around the axis 17A. An actuator 22 opens and closes the gripper to collect the individual cores from the gluing unit and insert them into the channel 31 defined between the stationary plate 19 and the fourth winding roller 21. To allow collection of the individual cores A by the gripper 18 of the inserter 17, the actuator 50 raises the terminal movable part 52A of the counter surface 52.

In the embodiment of FIGS. 17 to 25 the stationary plate 19 has a concave surface 19A that is longer than the one illustrated in the embodiments of FIGS. 1 to 16. Also in this case the surface 19A preferably has a substantially cylindrical form, roughly coaxial to the fourth winding roller 21 when the latter is in the position of FIG. 18. In this way a channel 31 is defined with substantially constant cross section and preferably slightly smaller than the diameter of the winding cores A. The initial position of the winding roller 21 and/or the stationary plate 19 can be modified according to the diameter of the winding cores used.

FIG. 17 furthermore illustrates the perforation unit 53 for producing the transverse perforated lines in the web material N. The perforation unit 53 can comprise a beam 54 with a fixed counter blade 55 cooperating with a roller 56 provided with a plurality of perforation blades 57. The perforation unit is known per se and will therefore not be described in further detail.

Figure 20:
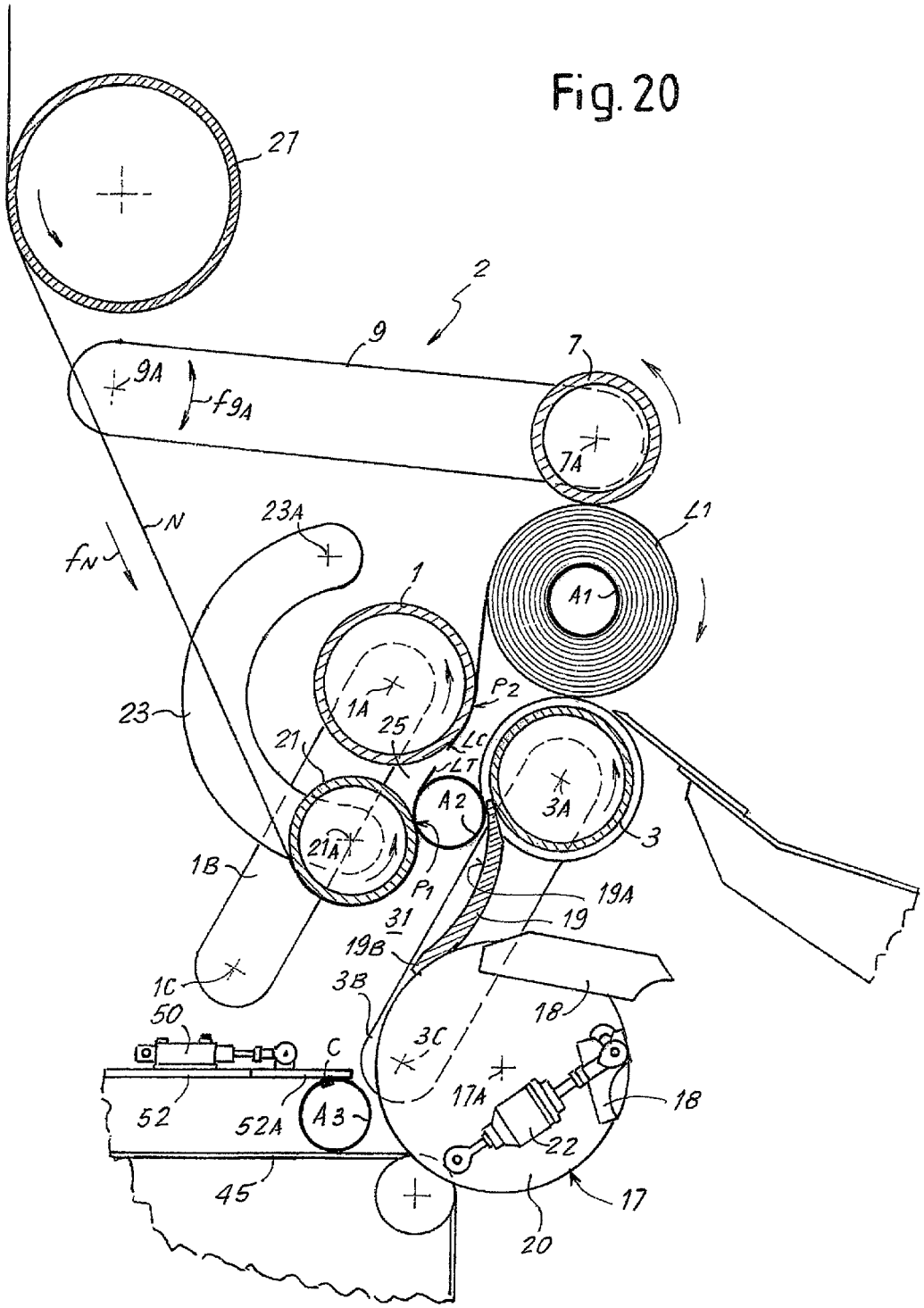
Figure 21:
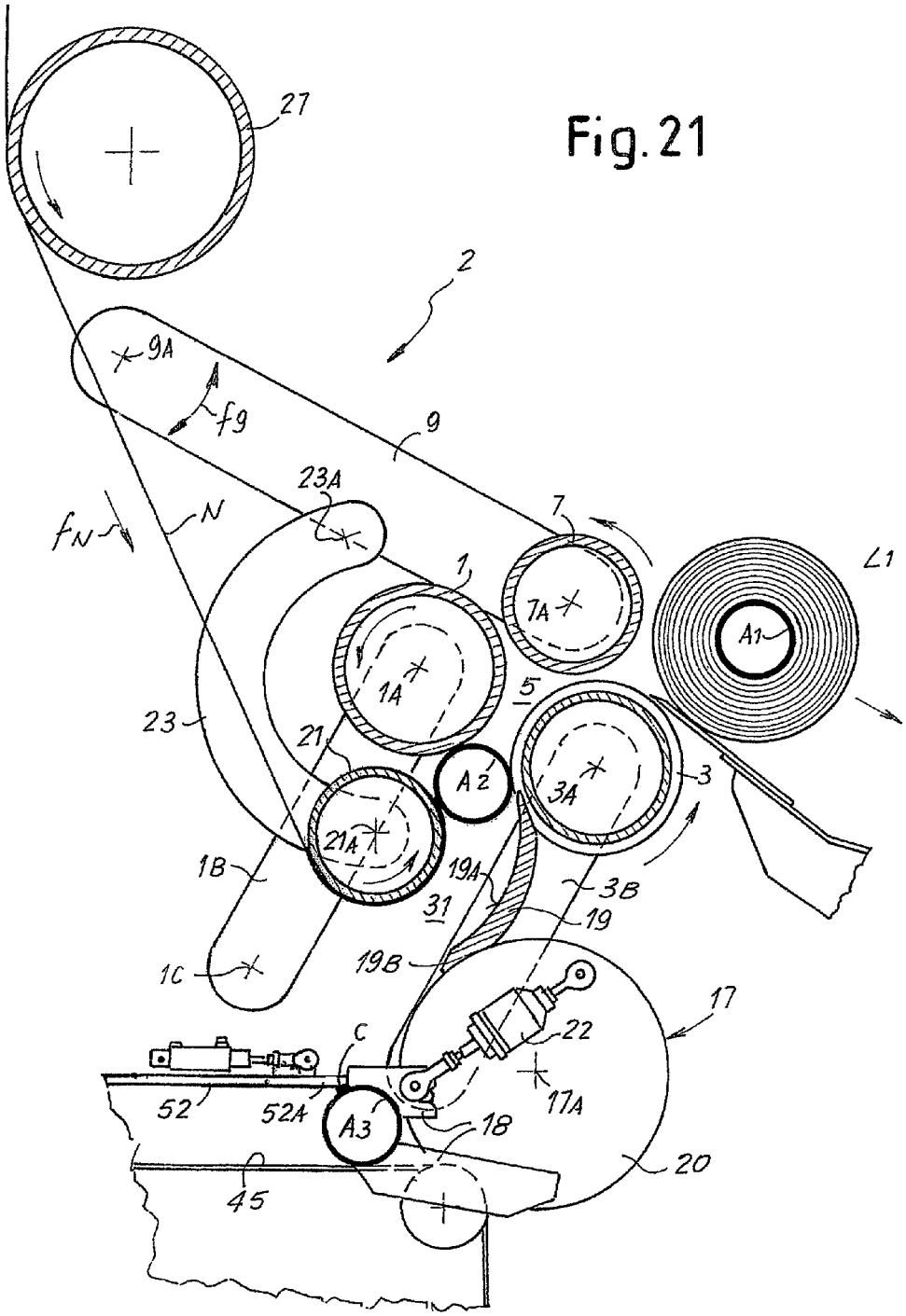
Figure 22:
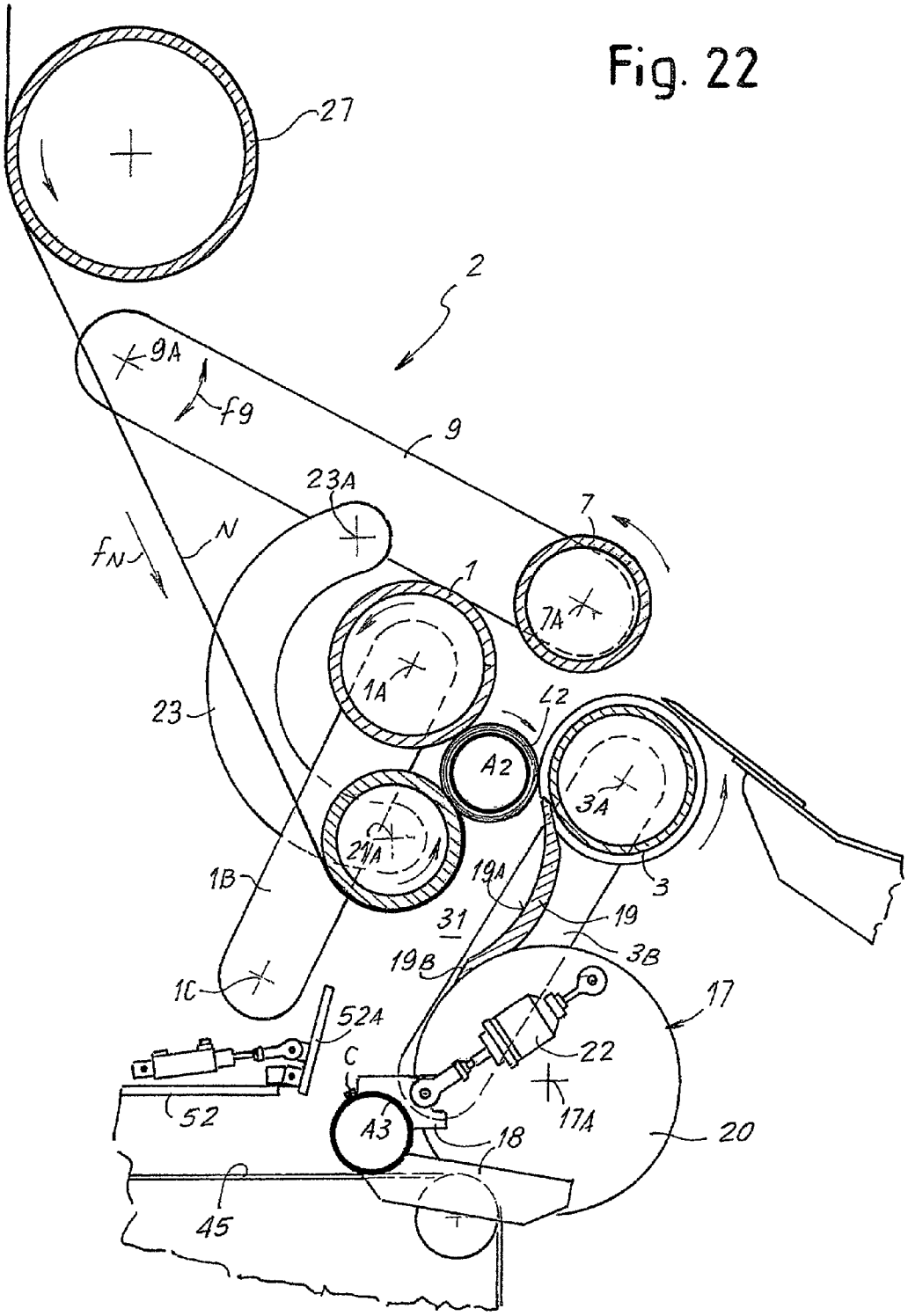
Figure 23:
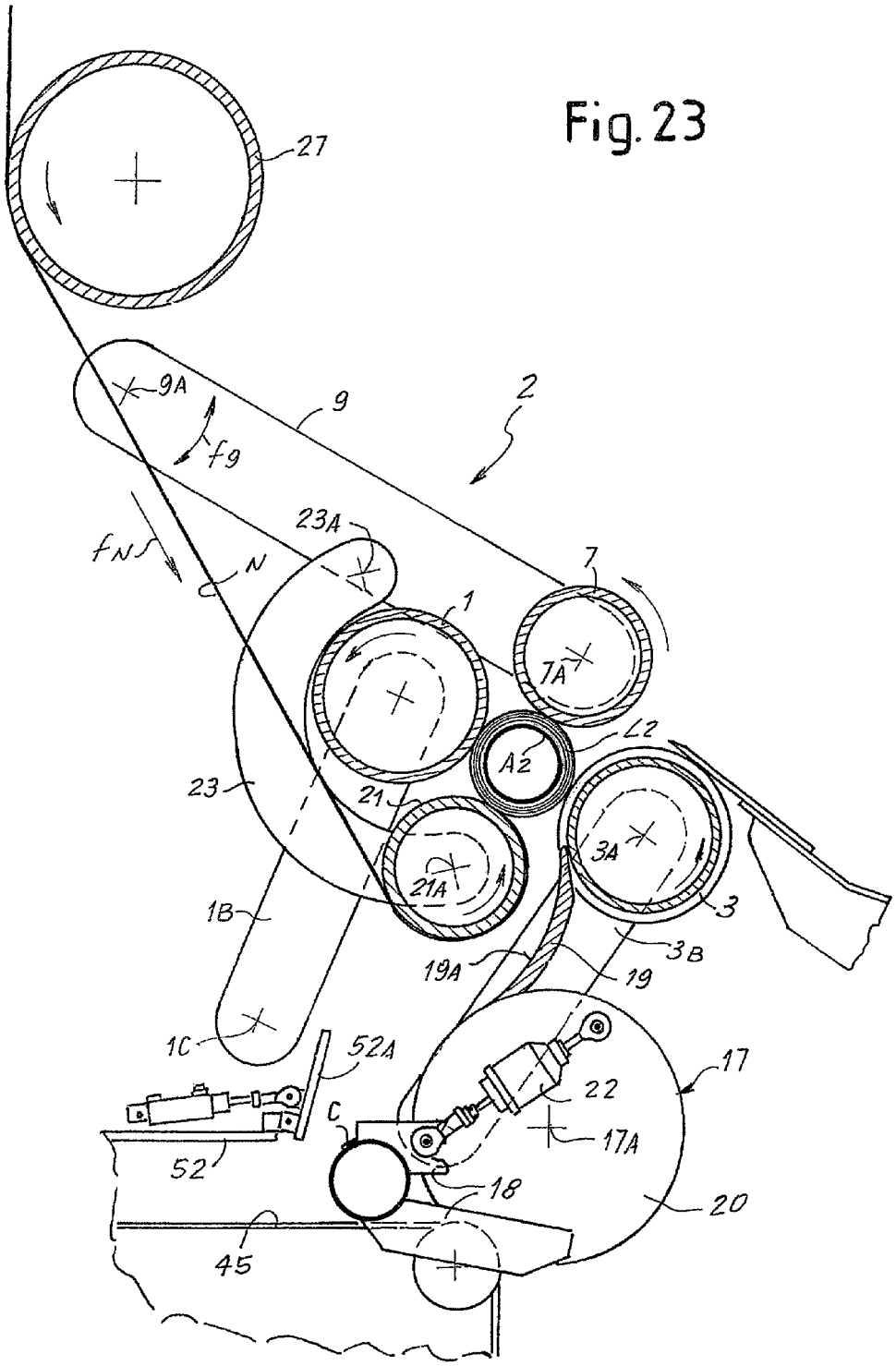
Figure 24:
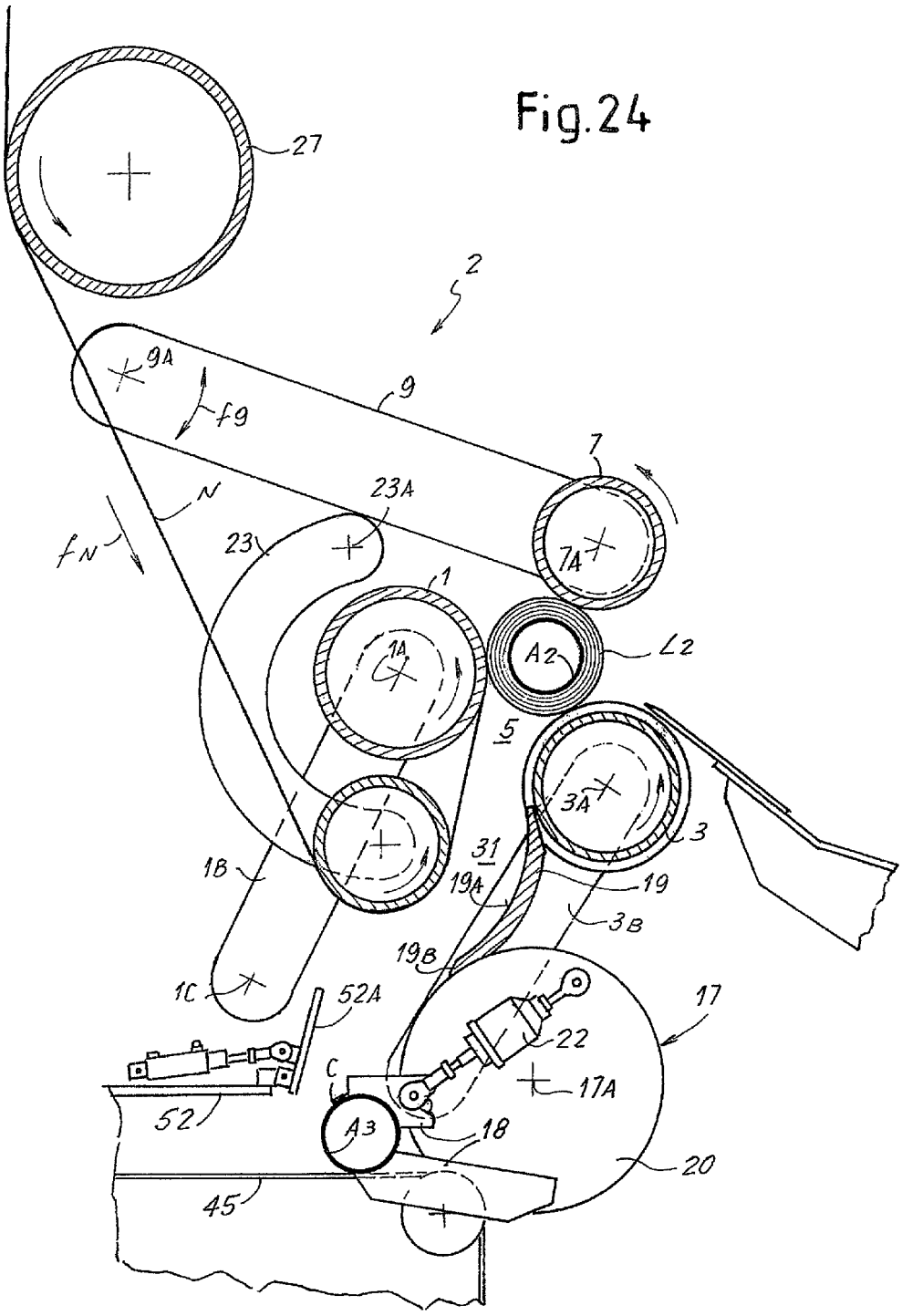
Figure 25:
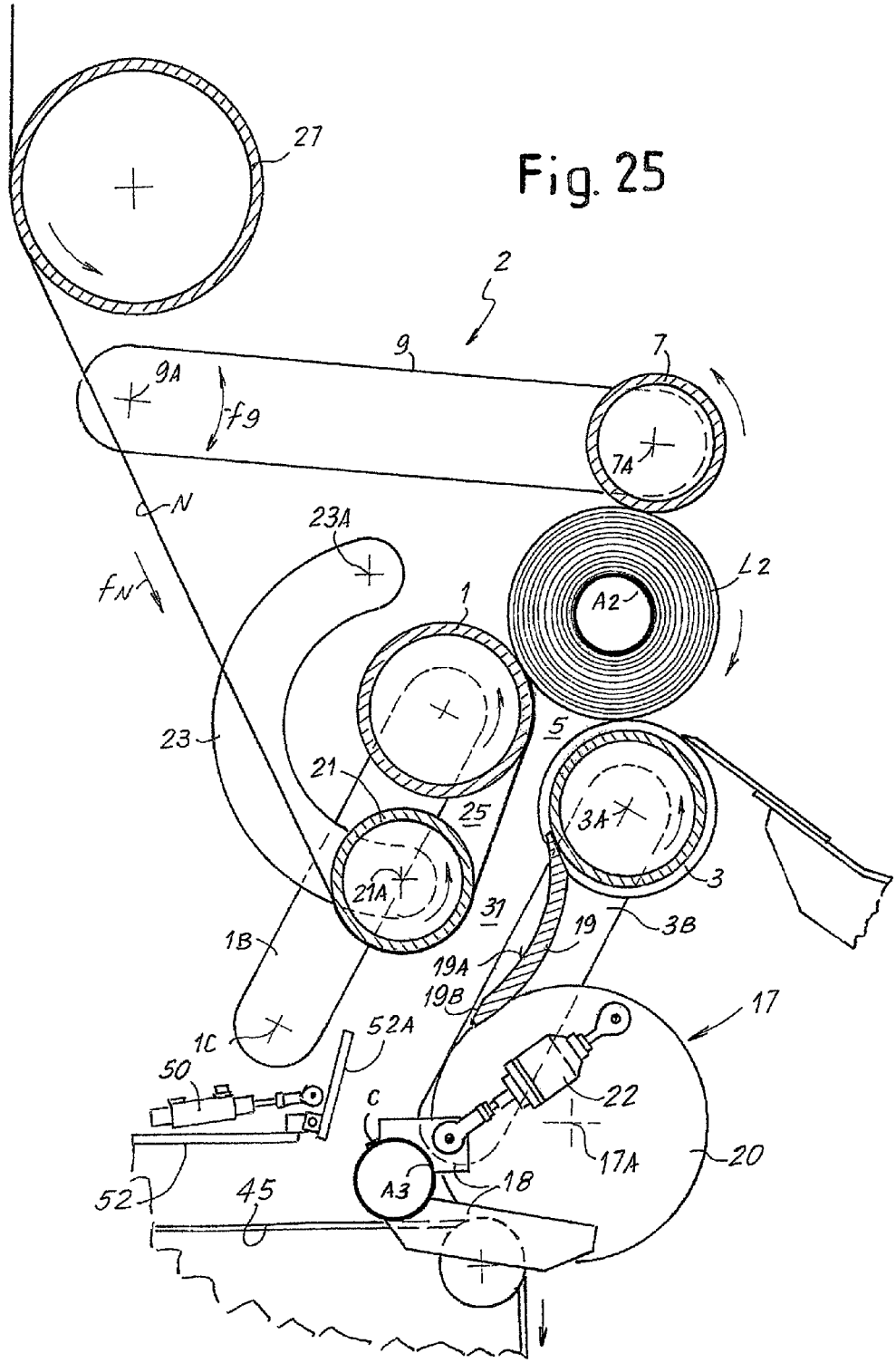

The sequence of FIGS. 18 to 25 shows, similarly to the sequence of FIGS. 1 to 8, the operation of the rewinding machine in the embodiment of FIG. 17. Since the various elements and components of the machine are equivalent and operate similarly to those of the embodiment of FIGS. 1 to 8, the winding cycle will not be described again and will be self-explanatory from the preceding description and FIGS. 18 to 25. It should be noted that the different form of the surface 19A of the stationary plate 19 provides (FIGS. 19, 20) the same function described with reference to FIGS. 2 and 3. The second core A2 inserted by the inserter 17 into the channel 31 formed by the surface 19A and by the fourth winding roller 21 is pressed against the winding roller 21 so that the web material N is pinched between the core A2 and the fourth winding roller 21. The core is accelerated due to the friction force generated at the point of contact with the web material N and with the surface 19A of the stationary plate 19 and begins to roll at an advancing speed equal to half the feed speed of the web material N, moving into the severing cradle 25 (FIG. 20). In this phase the glue C causes the web material N to adhere to the new core A2 and lengthening of the path of the web material which is pushed by the core A2 into the severing cradle 25 causes rupture of the web material N, preferably along a perforation line generated by the perforator 53, between the pinching area P1 (between winding roller 21 and core A2) and the contact area P2 between web material N and first winding roller 1.

To facilitate severing of the web material, the cylindrical outer surface of the first winding roller 1 can be provided with a coating (continuous or discontinuous, for example in annular bands) of material with a high friction coefficient, so-called "grip" to increase the friction coefficient between web material N and winding roller 1. A similar coating can be provided on the other winding rollers 3, 7 and 21 to favor the grip on the web material N and therefore more effectively transmit the force to keep the roll L1, L2 being wound in rotation. Also the surface 19A, 19B of the stationary plate can have a continuous or partial coating of material with high friction coefficient. In other embodiments one or more of the mechanical parts (rollers and stationary plate) which come into contact with the web material can have contact surfaces with the web material machined to obtain a high friction coefficient, for example using a processing that increases their roughness. A similar coating or treatment can be provided in the embodiments of FIGS. 1 to 16.

The leading edge LT for the new roll L2 and the trailing edge LC for the roll or log L1 are thus generated similarly to what has already been described.

The machine of FIG. 17 can be designed also with a winding roller 21 which is kept fixed during the winding cycle, which will be carried out in said case similarly to what has been illustrated in FIGS. 9 to 16.

Figure 26:
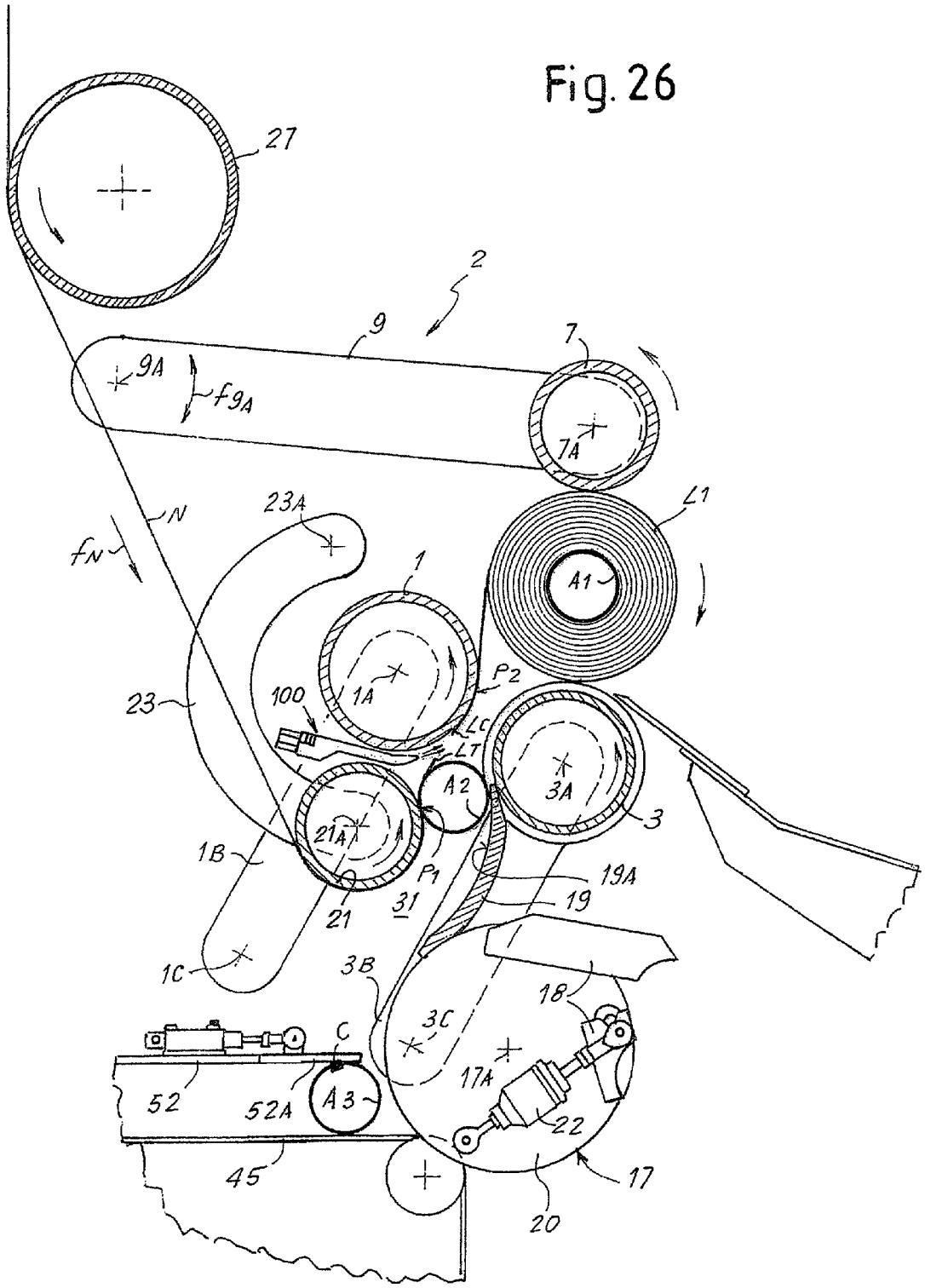
FIG. 26 shows a further embodiment of the rewinding machine according to the invention.

FIG. 26 shows a modified embodiment of the rewinding machine according to the invention. In this embodiment a blowing system 100 is arranged between the rollers 1 and 21. In some embodiments the blowing system 100 comprises a plurality of nozzles preferably aligned in a direction substantially parallel to the axes of the rollers 1 and 21. The blowing nozzles generate a series of air jets onto the surface of the web material N facing the rollers 1 and 21. The jet of air can facilitate severing of the web material. A similar blowing system could be provided in the embodiment illustrated in FIGS. 1 to 16.

The nozzles of the blowing system 100 can be controlled to generate a jet of air synchronized with the movement of the winding core towards the inside of the severing cradle 25.

Figure 27:
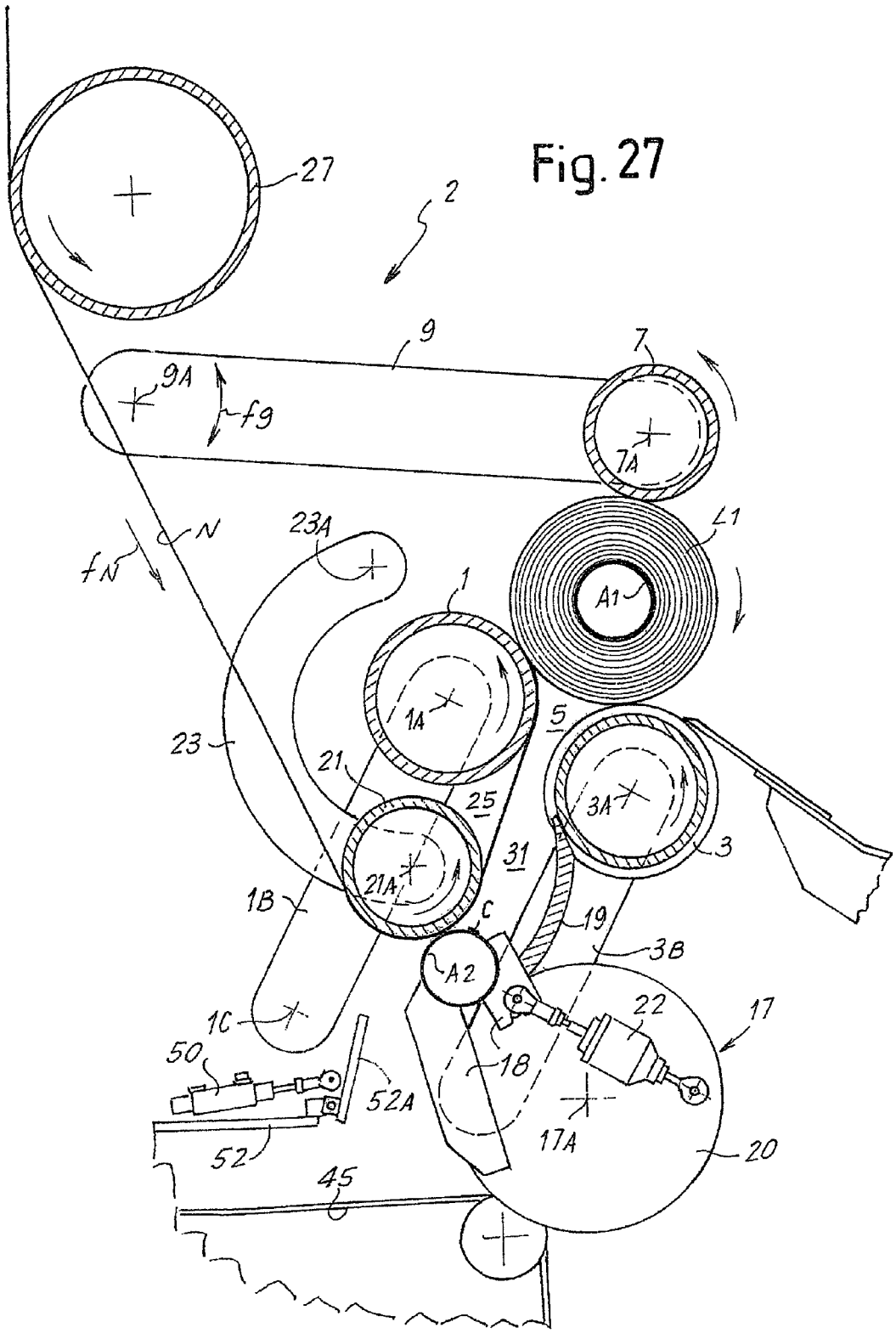
FIGS. 27 and 28 show a further embodiment of the rewinding machine according to the invention with a different arrangement for obtaining severing of the web material upon completion of winding of each roll or log.
Figure 28:
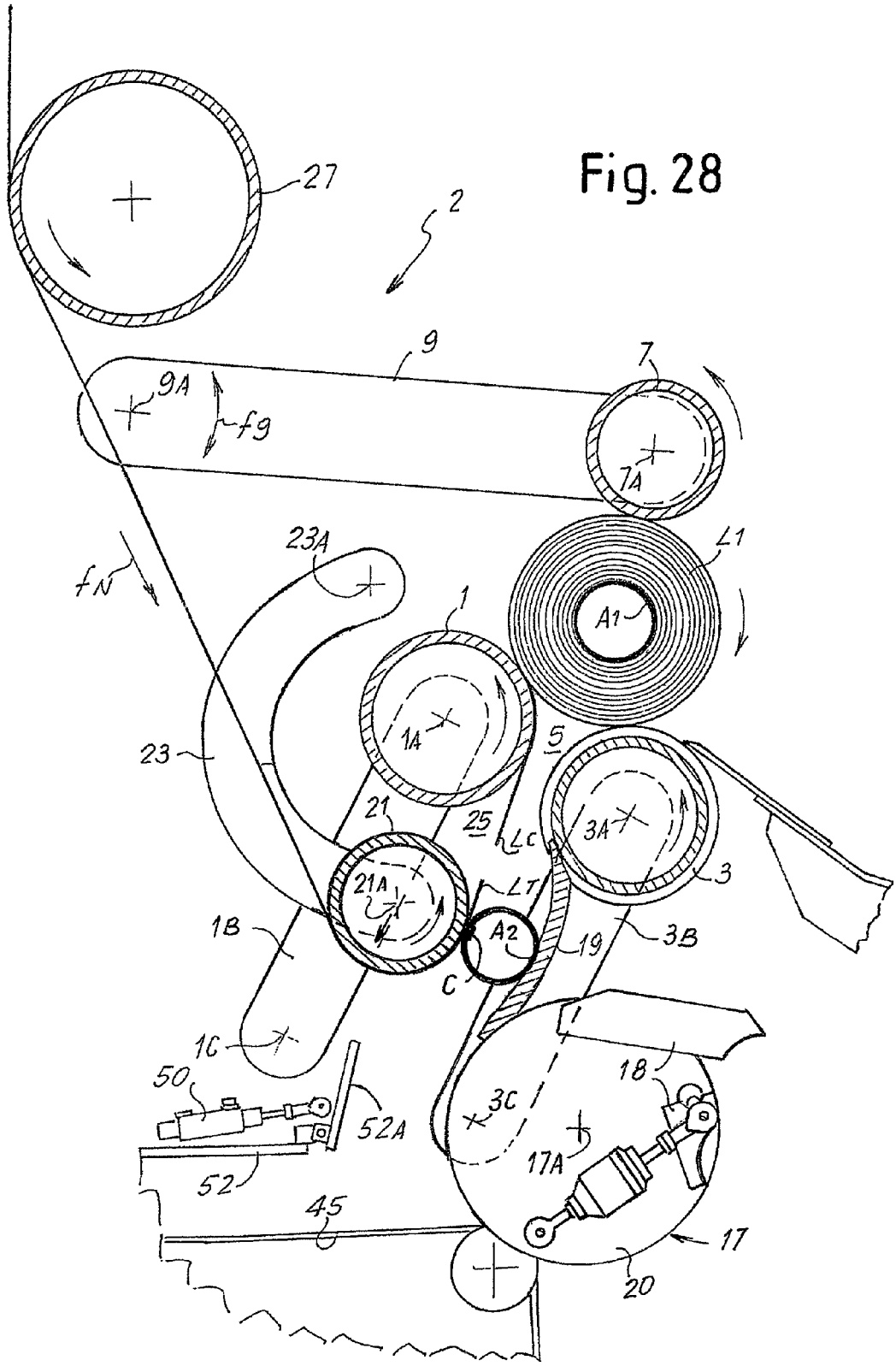

In the embodiments of FIGS. 1 to 26 the severing or rupture of the web material N upon completion of the winding is obtained by lengthening of the path of the web material N between the rollers 1 and 21 caused by the movement of the winding core towards the severing cradle 25. FIGS. 27 and 28 show, limited to the severing phase of the web material, a different method of lengthening the path of the material in the section between the rollers 21 and 1. In this embodiment the distance between the centers of the rollers 1 and 21 is variable. Preferably the roller 1 has a fixed rotation axis 1A, while the roller 21 has a movable rotation axis 21A to move away from the axis 1A of the roller 1. When the winding core A2 comes into contact with the web material N, pinching it between the core and the surface of the roller 21, the distance between the centers of the two rollers 1 and 21 can be promptly and temporarily increased, causing a lengthening of the section of web material between the two rollers and therefore the severing thereof. Subsequently the two rollers can be moved near each other again and the roller 21 can if necessary perform a movement to accompany the new winding core A2 towards the nip 5 as previously described.

In all the embodiments the glue C is applied to the winding cores A1, A2 so that it is in the most favorable angular position for adhesion of the free leading edge of the web material to the winding core. In practice, the angular position of the line of glue C is controlled to be as near as possible to the perforated line which breaks due to lengthening of the path of the web material between the rollers 1 and 21.

The winding cores A1, A2 can consist of tubes of cardboard, paper, plastic or other material which is subsequently cut when the respective roll or log is divided into small rolls. In other embodiments the winding cores are formed of spindles which can be extracted from the completed rolls or logs and then recycled to wind subsequent rolls or log.

It is understood that the drawing only shows an example provided solely by way of practical demonstration of the invention, which can vary in its forms and arrangements without departing from the scope of the concept underlying the invention. Any reference numbers in the attached claims are provided to facilitate reading of the claims with reference to the description and the drawing, and do not limit the protective scope of the claims.

The invention claimed is:

1. A method for winding a web material around a winding core and producing a roll of web material comprising:

providing a first winding roller and a second winding roller forming a winding nip through which winding cores and web material pass;

winding a predetermined quantity of said web material around a first winding core to form a first roll;

after winding said first roll, severing the web material and starting to wind a second roll around a second winding core, wherein the web material is severed by lengthening a path of said web material between said first winding roller and a further roller, arranged upstream of said first winding roller with respect to a direction of advancement of said web material, around which said web material is guided;

wherein the path of the web material is lengthened between said first winding roller and said further roller by pushing the web material into a cradle between said first winding roller and said further roller; and wherein the path of the web material is lengthened between said first winding roller and said further roller by said second winding core pushing the web material into the cradle between said first winding roller and said further roller.

2. The method according to claim 1, wherein the web material is tensioned prior to the path of said web material being lengthened in order to facilitate severing of the web material.

3. The method according to claim 1, wherein said web material is fed at a substantially constant rate during winding of the first roll and the second roll, and during severing of the web material.

4. The method according to claim 1, further comprising:

providing a third winding roller downstream from said winding nip, defining a winding cradle together with the first winding roller and the second winding roller, providing said further roller as a fourth winding roller upstream from said winding nip, defining together with the first winding roller a cradle for severing the web material;

feeding the web material around the fourth winding roller and the first winding roller through said winding nip and towards the winding cradle, and winding said web material around the first winding core in said winding cradle to form said first roll;

pinching the web material between said second winding core and said fourth winding roller, by moving said second core against the fourth winding roller.

5. The method according to claim 4, wherein, after the web material has been pinched between said second winding core and said fourth winding roller, said second winding core is inserted in the severing cradle between the fourth winding roller and the first winding roller, thereby lengthening the path of the web material and severing of the web material at a point between the second winding core and the first roll.

6. The method according to claim 5, further comprising:

keeping said second winding core between the first winding roller, the second winding roller and the fourth winding roller to wind a first part of said predetermined quantity of web material on said second winding core;

gradually displacing said second winding core and the second roll forming thereon through the winding nip and into the winding cradle defined by the first winding roller, the second winding roller and the third winding roller, while said web material continues to be wound around said second winding core;

completing winding of the second roll in said winding cradle.

7. The method according to claim 6, wherein during winding of the web material around said second winding core, the second roll is kept in contact with the fourth winding roller for at least a part of advancing movement of the second roll through said winding nip.

8. The method according to claim 7, wherein a roll being wound is kept constantly in contact with at least three of said first winding roller, said second winding roller, said third winding roller and said fourth winding roller throughout a winding cycle, the fourth winding roller losing contact with said roll being wound only after said roll being wound has come into contact with said third winding roller, while remaining in contact with said first winding roller and said second winding roller.

9. The method according to claim 8, wherein a part of the web material is wound while the roll being wound is kept in contact with the first winding roller, the second winding roller, the third winding roller and the fourth winding roller.

10. The method according to claim 4, wherein said first winding roller and said second winding roller are moved away from one another during passage of the second winding core through said winding nip.

11. The method according to claim 4, wherein said first winding roller, said second winding roller, said third winding roller and said fourth winding roller rotate substantially at a common peripheral speed during a substantial part of a winding cycle of each roll.

12. The method according to claim 4, wherein said first winding roller and said fourth winding roller always rotate substantially at a common peripheral speed, and said second winding roller rotates substantially at the common peripheral speed of the first winding roller and said fourth winding roller except for a step of angular deceleration and subsequent acceleration to make the second winding core and the second roll forming thereon advance through said winding nip.

13. The method according to claim 4, further comprising forcing said second winding core between said fourth winding roller and a stationary plate located at a distance from said fourth winding roller so as to cause pinching of the web material between said fourth winding roller and said second winding core when said second winding core is forced between said stationary plate and said fourth winding roller.

14. A peripheral rewinding machine for producing rolls of web material wound around winding cores comprising: a first winding roller and a second winding roller defining a winding nip; an inserter for inserting winding cores in said winding nip, so that said winding cores pass through said winding nip; a third winding roller located downstream from said winding nip, with said first winding roller, said second winding roller and said third winding roller defining a winding cradle; a feed path for said web material that extends through said winding nip;

wherein upstream from said winding nip, a fourth winding roller is present distanced from said first winding roller and forming with said first winding roller an area for severing the web material;

wherein the feed path of the web material extends around said fourth winding roller and around said first winding roller in said area for severing;

wherein said inserter, said first winding roller and said fourth winding roller are positioned and controlled such that a winding core moved towards the fourth winding roller serves to pinch the web material between said fourth winding roller and said winding core; and wherein said fourth winding roller and said first winding roller are movable in a controlled manner in relation to one another to increase distance between a center of said first winding roller and a center of said fourth winding roller on completion of winding of a roll of web material, thereby lengthening a path of the web material between said first winding roller and said fourth winding roller up until the web material is severed.

15. The rewinding machine according to claim 14, further comprising an arrangement for lengthening the web material until said web material is severed between the first winding roller and the fourth winding roller on completion of winding of each roll.

16. The rewinding machine according to claim 14, wherein said first winding roller, said fourth winding roller and said inserter are positioned and controlled so as to make said winding core move inside a cradle for severing the web material defined between the first winding roller and the fourth winding roller, thereby lengthening a path of the web material and causing severing of the web material between said winding core and a roll being formed in the winding cradle.

17. A peripheral rewinding machine for producing rolls of web material wound around winding cores comprising: a first winding roller and a second winding roller defining a winding nip; an inserter for inserting winding cores in said winding nip, so that said winding cores pass through said winding nip; a third winding roller located downstream from said winding nip, with said first winding roller, said second winding roller and said third winding roller defining a winding cradle; a feed path for said web material that extends through said winding nip;

wherein upstream from said winding nip, a fourth winding roller is present distanced from said first winding roller and forming with said first winding roller an area for severing the web material;

wherein the feed path of the web material extends around said fourth winding roller and around said first winding roller in said area for severing; and wherein upstream from said winding nip, a stationary plate is present at a distance from said fourth winding roller and defining with said fourth winding roller a channel for insertion of said winding cores, the distance between the stationary plate and the fourth winding roller being such that a winding core inserted in said channel is forced against the fourth winding roller and serves to pinch the web material between said winding core and said fourth winding roller.

18. The rewinding machine according to claim 17, wherein said stationary plate defines a rolling surface for the winding cores tangent to the second winding roller.

19. The rewinding machine according to claim 17, wherein said second winding roller is controlled at a cyclically variable peripheral speed to make a winding core advance through the winding nip.

20. The rewinding machine according to claim 17, wherein said third winding roller is controlled at a variable peripheral speed to tension the web material on completion of winding of each roll.

21. The rewinding machine according to claim 17, wherein said first winding roller and said fourth winding roller are controlled to rotate at a substantially common constant peripheral speed.

22. The rewinding machine according to claim 17, wherein said first winding roller and said second winding roller are positioned and controlled to move away from each other so as to modify width of said winding nip to enable passage of a winding core through said winding nip.

23. The rewinding machine according to claim 17, wherein said first winding roller, said second winding roller, said third winding roller and said fourth winding roller are positioned and controlled so that a roll forming around one winding core is in contact with the first winding roller, the second winding roller, the third winding roller and the fourth winding roller for at least a part of a winding cycle, during which the roll being formed completes a plurality of rotations around an axis of the roll.

24. The rewinding machine according to claim 17, wherein said first winding roller, said second winding roller, said third winding roller and said fourth winding roller are positioned and controlled so as to define a straight path along which a winding core advances from a position upstream from said winding nip where winding starts to a position downstream from said winding nip where winding stops.

25. The rewinding machine according to claim 17, further comprising air delivery nozzles located between said first winding roller and said fourth winding roller.

26. A peripheral rewinding machine for producing rolls of web material wound around winding cores comprising: a first winding roller and a second winding roller defining a winding nip; an inserter for inserting winding cores in said winding nip, so that said winding cores pass through said winding nip; a third winding roller located downstream from said winding nip, with said first winding roller, said second winding roller and said third winding roller defining a winding cradle; a feed path for said web material that extends through said winding nip;

wherein upstream from said winding nip, a fourth winding roller is present distanced from said first winding roller and forming with said first winding roller an area for severing the web material;

wherein the feed path of the web material extends around said fourth winding roller and around said first winding roller in said area for severing; and wherein said fourth winding roller is supported with a movable axis and controlled so that said fourth winding roller moves closer to the winding nip when a new winding core advances towards and through said winding nip.

27. A peripheral rewinding machine for producing rolls of web material wound around winding cores comprising: a first winding roller and a second winding roller defining a winding nip; an inserter for inserting winding cores in said winding nip, so that said winding cores pass through said winding nip; a third winding roller located downstream from said winding nip, with said first winding roller, said second winding roller and said third winding roller defining a winding cradle; a feed path for said web material that extends through said winding nip;

wherein upstream from said winding nip, a fourth winding roller is present distanced from said first winding roller and forming with said first winding roller an area for severing the web material;

wherein the feed path of the web material extends around said fourth winding roller and around said first winding roller in said area for severing; and wherein said first winding roller, said second winding roller, said third winding roller and said fourth winding roller are positioned and controlled so that a roll forming around a winding core is always in contact with at least three of said first winding roller, said second winding roller, said third winding roller and said fourth winding roller.

28. A method for producing rolls of web material, including guiding web material around two winding rollers and severing the web material upon completion of winding of a roll by lengthening a path of the web material between said two rollers by increasing distance between centers of said two rollers.

29. A peripheral rewinding machine for producing rolls of web material wound onto winding cores, comprising two rollers around which web material is guided and an arrangement for lengthening a path along which the web material advances between said two rollers until the web material is severed, after which winding of a new roll begins on a new winding core; wherein said arrangement comprises a mechanism for distancing said two rollers from one another.

30. An automatic continuous peripheral rewinding machine for producing rolls of web material wound onto winding cores, comprising four winding rollers defining (a) a first winding cradle between a first winding roller, a second winding roller and a third winding roller, and (b) a second winding cradle between said first winding roller, said second winding roller and a fourth winding roller; wherein said first winding roller and said second winding roller define a nip through which the winding cores being wound with said web material travel, and through which the web material is fed towards a roll being formed in the first winding cradle; wherein said four winding rollers are positioned and controlled so as to wind an initial portion of a roll between said first winding roller, said second winding roller and said fourth winding roller, and wind a final portion of the roll between said first winding roller, said second winding roller and said third winding roller; said third winding roller being located downstream from said nip and said fourth winding roller being located upstream from said nip in relation to a direction in which the winding cores advance.

31. A method for winding a web material and sequentially forming rolls of said web material wound onto winding cores, comprising providing four winding rollers defining (a) a first winding cradle between a first winding roller, a second winding roller and a third winding roller, and (b) a second winding cradle between said first winding roller, said second winding roller and a fourth winding roller; completing a first part of a winding cycle for each roll in the second winding cradle, and a second part of the winding cycle for each roll in the first winding cradle; and during the winding cycle, the roll passes from the second winding cradle to the first winding cradle through a nip defined between the first winding roller and the second winding roller.

32. The method according to claim 31 further comprising:

(a) feeding a winding core towards said second winding cradle;

(b) anchoring a leading edge of the web material to said winding core;

(c) winding a portion of a roll of web material while keeping said winding core in said second winding cradle, advancing said winding core towards the first winding cradle;

(d) completing the winding of the roll of web material in said first winding cradle;

(e) severing the web material, thereby forming a leading edge of web material, and unloading the roll of web material from the first winding cradle;

(f) repeating steps (a) to (e) without interrupting advancement of the web material.

* * * * *